US009214122B2

(12) United States Patent
Kawabata et al.

(10) Patent No.: US 9,214,122 B2
(45) Date of Patent: Dec. 15, 2015

(54) LCD DEVICE AND TELEVISION RECEIVER

(75) Inventors: Masae Kawabata, Osaka (JP); Fumikazu Shimoshikiryoh, Osaka (JP); Kentaroh Irie, Osaka (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 571 days.

(21) Appl. No.: 13/512,174

(22) PCT Filed: Sep. 7, 2010

(86) PCT No.: PCT/JP2010/065341
§ 371 (c)(1),
(2), (4) Date: May 25, 2012

(87) PCT Pub. No.: WO2011/065091
PCT Pub. Date: Jun. 3, 2011

(65) Prior Publication Data

US 2012/0274860 A1 Nov. 1, 2012

(30) Foreign Application Priority Data

Nov. 27, 2009 (JP) ..... 2009-270816

(51) Int. Cl.
*G09G 3/36* (2006.01)
*G09G 3/20* (2006.01)

(52) U.S. Cl.
CPC ..... *G09G 3/3648* (2013.01); *G09G 3/2022* (2013.01); *G09G 3/36* (2013.01);
(Continued)

(58) Field of Classification Search
USPC ..... 345/88, 89, 104, 596, 690; 348/731
See application file for complete search history.

(56) References Cited

U.S. PATENT DOCUMENTS 5,479,188 A * 12/1995 Moriyama ..... 345/89
5,847,688 A 12/1998 Ohi et al.
(Continued)

FOREIGN PATENT DOCUMENTS

CN 101303840 11/2008
JP 5-210356 8/1993
(Continued)

OTHER PUBLICATIONS

International Search Report mailed Oct. 5, 2010, directed to International Application No. PCT/JP2010/065341; 4 pages.

*Primary Examiner* — Jason Olson
*Assistant Examiner* — Sosina Abebe
(74) *Attorney, Agent, or Firm* — Morrison & Foerster LLP

(57) ABSTRACT

A liquid crystal display device which carries out a single tone display with a change in pixel luminance during a single cycle composed of first to mth frame periods (m is an integer of 4 or more), includes: pixels of a first type in which when a halftone is displayed, supply of two or more kinds of data voltage during at least either the first to nth frame periods (n is an integer of 2 or more to m or less) or the (n+1)th to mth frame periods causes liquid crystal layers to produce rise responses during the first to nth frame periods and produce decay responses during the (n+1)th to mth frame periods; and pixels of a second type in which when a halftone is displayed, supply of two or more kinds of data voltage during at least either the first to nth frame periods or the (n+1)th to mth frame periods causes liquid crystal layers to produce decay responses during the first to nth frame periods and produce rise responses during the (n+1)th to mth frame periods. This makes it possible to achieve both an improvement in viewing angle characteristic and a reduction in flickers.

23 Claims, 18 Drawing Sheets

(52) U.S. Cl.
CPC ..... *G09G 3/3607* (2013.01); *G09G 3/3614* (2013.01); *G09G 2300/0447* (2013.01); *G09G 2320/028* (2013.01); *G09G 2320/0247* (2013.01); *G09G 2320/0285* (2013.01)

(56) References Cited

U.S. PATENT DOCUMENTS

| | | | | |
|---|---|---|---|---|
| 6,072,451 | A | 6/2000 | Mano et al. | |
| 6,222,515 | B1 | 4/2001 | Yamaguchi et al. | |
| 2001/0038372 | A1 | 11/2001 | Lee | |
| 2002/0149598 | A1* | 10/2002 | Greier et al. | 345/589 |
| 2003/0058211 | A1 | 3/2003 | Kim et al. | |
| 2003/0146893 | A1* | 8/2003 | Sawabe | 345/89 |
| 2004/0239698 | A1* | 12/2004 | Kamada et al. | 345/714 |
| 2005/0017991 | A1 | 1/2005 | Yamazaki et al. | |
| 2005/0231497 | A1* | 10/2005 | Harada | G09G 3/3614 345/204 |
| 2008/0252583 | A1 | 10/2008 | Sakashita et al. | |
| 2009/0009455 | A1* | 1/2009 | Kimura | G09G 3/2074 345/89 |
| 2010/0253668 | A1* | 10/2010 | Sugihara et al. | 345/211 |

FOREIGN PATENT DOCUMENTS

| | | |
|---|---|---|
| JP | 6-347758 | 12/1994 |
| JP | 7-121144 | 5/1995 |
| JP | 2003-99017 | 4/2003 |
| JP | 2004-334153 | 11/2004 |
| JP | 2008-139580 | 6/2008 |
| JP | 2008-197349 | 8/2008 |
| JP | 2008-262105 | 10/2008 |
| JP | 2009-20197 | 1/2009 |
| KR | 2001-0077568 | 8/2001 |

* cited by examiner

Fig. 6

| INPUT TONES | LUTa | LUTb | LUTc | LUTd |
|---|---|---|---|---|
| 0 | 0 | 0 | 0 | 0 |
| 1 | 3 | 0 | 8 | 0 |
| 2 | 8 | 0 | 46 | 0 |
| 3 | 11 | 0 | 67 | 0 |
| 4 | 14 | 0 | 79 | 0 |
| 5 | 15 | 0 | 86 | 0 |
| 6 | 17 | 0 | 93 | 0 |
| 7 | 18 | 0 | 98 | 0 |
| 8 | 19 | 0 | 103 | 0 |
| 9 | 20 | 0 | 107 | 0 |
| 10 | 21 | 0 | 110 | 0 |
| 11 | 22 | 0 | 113 | 0 |
| 12 | 23 | 0 | 116 | 0 |
| 13 | 25 | 0 | 118 | 0 |
| 14 | 26 | 0 | 120 | 0 |
| 15 | 27 | 0 | 122 | 0 |
| 16 | 28 | 0 | 124 | 0 |
| 17 | 29 | 0 | 125 | 0 |
| 18 | 31 | 0 | 127 | 0 |
| 19 | 32 | 0 | 129 | 0 |
| 20 | 33 | 0 | 131 | 0 |
| 21 | 35 | 0 | 132 | 0 |
| 22 | 36 | 0 | 134 | 0 |
| 23 | 38 | 0 | 135 | 0 |
| 24 | 39 | 0 | 137 | 0 |
| 25 | 40 | 0 | 138 | 0 |
| 26 | 42 | 0 | 140 | 0 |
| 27 | 43 | 0 | 141 | 0 |
| 28 | 44 | 0 | 142 | 0 |
| 29 | 45 | 0 | 144 | 0 |
| 30 | 47 | 0 | 145 | 0 |
| 31 | 48 | 0 | 146 | 0 |
| 32 | 50 | 0 | 147 | 0 |
| 33 | 51 | 0 | 149 | 0 |
| 34 | 53 | 0 | 150 | 0 |
| 35 | 54 | 0 | 151 | 0 |
| 36 | 56 | 0 | 152 | 0 |
| 37 | 57 | 0 | 153 | 0 |
| 38 | 59 | 0 | 154 | 0 |
| 39 | 60 | 0 | 155 | 0 |
| 40 | 62 | 0 | 156 | 0 |
| 41 | 64 | 0 | 157 | 0 |
| 42 | 65 | 0 | 158 | 0 |
| 43 | 67 | 0 | 159 | 0 |
| 44 | 68 | 0 | 160 | 0 |
| 45 | 69 | 0 | 161 | 0 |
| 46 | 71 | 0 | 162 | 0 |
| 47 | 72 | 0 | 163 | 0 |
| 48 | 73 | 0 | 164 | 0 |
| 49 | 75 | 0 | 165 | 0 |
| 50 | 76 | 0 | 166 | 0 |
| 51 | 78 | 0 | 166 | 0 |
| 52 | 79 | 0 | 167 | 0 |
| 53 | 81 | 0 | 168 | 0 |
| 54 | 82 | 0 | 169 | 0 |
| 55 | 83 | 0 | 170 | 0 |
| 56 | 85 | 0 | 171 | 0 |
| 57 | 86 | 0 | 172 | 0 |
| 58 | 88 | 0 | 173 | 0 |
| 59 | 89 | 0 | 173 | 0 |
| 60 | 91 | 0 | 174 | 0 |
| 61 | 92 | 0 | 175 | 0 |
| 62 | 94 | 0 | 176 | 0 |
| 63 | 95 | 0 | 177 | 0 |
| 64 | 97 | 0 | 178 | 0 |
| 65 | 98 | 0 | 178 | 0 |
| 66 | 100 | 0 | 179 | 0 |
| 67 | 101 | 0 | 180 | 0 |
| 68 | 102 | 0 | 181 | 0 |
| 69 | 104 | 0 | 182 | 0 |
| 70 | 106 | 0 | 183 | 0 |

| INPUT TONES | LUTa | LUTb | LUTc | LUTd |
|---|---|---|---|---|
| 71 | 107 | 0 | 183 | 0 |
| 72 | 109 | 0 | 184 | 0 |
| 73 | 110 | 0 | 185 | 0 |
| 74 | 111 | 0 | 186 | 0 |
| 75 | 113 | 0 | 186 | 0 |
| 76 | 115 | 0 | 187 | 0 |
| 77 | 116 | 0 | 188 | 0 |
| 78 | 118 | 0 | 189 | 0 |
| 79 | 120 | 0 | 190 | 0 |
| 80 | 121 | 0 | 191 | 0 |
| 81 | 123 | 0 | 192 | 0 |
| 82 | 124 | 0 | 192 | 0 |
| 83 | 126 | 0 | 193 | 0 |
| 84 | 127 | 0 | 194 | 0 |
| 85 | 129 | 0 | 194 | 0 |
| 86 | 131 | 0 | 195 | 0 |
| 87 | 133 | 0 | 196 | 0 |
| 88 | 135 | 0 | 197 | 0 |
| 89 | 137 | 0 | 197 | 0 |
| 90 | 138 | 0 | 198 | 0 |
| 91 | 140 | 0 | 199 | 0 |
| 92 | 143 | 0 | 199 | 0 |
| 93 | 144 | 0 | 200 | 0 |
| 94 | 146 | 0 | 201 | 0 |
| 95 | 148 | 0 | 201 | 0 |
| 96 | 149 | 0 | 202 | 0 |
| 97 | 151 | 0 | 203 | 0 |
| 98 | 153 | 0 | 204 | 0 |
| 99 | 154 | 0 | 204 | 0 |
| 100 | 156 | 0 | 205 | 0 |
| 101 | 157 | 0 | 206 | 0 |
| 102 | 158 | 0 | 207 | 0 |
| 103 | 160 | 0 | 207 | 0 |
| 104 | 161 | 0 | 208 | 0 |
| 105 | 162 | 0 | 209 | 0 |
| 106 | 164 | 0 | 209 | 0 |
| 107 | 165 | 0 | 210 | 0 |
| 108 | 166 | 0 | 211 | 0 |
| 109 | 167 | 0 | 211 | 0 |
| 110 | 168 | 0 | 212 | 0 |
| 111 | 169 | 0 | 212 | 0 |
| 112 | 170 | 0 | 213 | 0 |
| 113 | 171 | 0 | 213 | 0 |
| 114 | 172 | 0 | 214 | 0 |
| 115 | 173 | 0 | 214 | 0 |
| 116 | 174 | 0 | 215 | 0 |
| 117 | 175 | 0 | 215 | 0 |
| 118 | 176 | 0 | 216 | 0 |
| 119 | 177 | 0 | 216 | 0 |
| 120 | 178 | 0 | 217 | 0 |
| 121 | 179 | 0 | 217 | 0 |
| 122 | 181 | 0 | 218 | 0 |
| 123 | 182 | 0 | 218 | 0 |
| 124 | 183 | 0 | 219 | 0 |
| 125 | 184 | 0 | 219 | 0 |
| 126 | 185 | 0 | 220 | 0 |
| 127 | 186 | 0 | 220 | 0 |
| 128 | 187 | 0 | 221 | 0 |
| 129 | 188 | 0 | 221 | 0 |
| 130 | 189 | 0 | 221 | 0 |
| 131 | 190 | 0 | 222 | 0 |
| 132 | 191 | 0 | 222 | 0 |
| 133 | 192 | 0 | 223 | 0 |
| 134 | 193 | 0 | 223 | 0 |
| 135 | 193 | 0 | 224 | 0 |
| 136 | 194 | 0 | 224 | 0 |
| 137 | 195 | 0 | 224 | 0 |
| 138 | 196 | 0 | 225 | 0 |
| 139 | 197 | 0 | 225 | 0 |
| 140 | 198 | 0 | 226 | 0 |

Fig. 7

| INPUT TONES | LUTa | LUTb | LUTc | LUTd |
|---|---|---|---|---|
| 141 | 199 | 0 | 226 | 0 |
| 142 | 200 | 0 | 227 | 0 |
| 143 | 201 | 0 | 227 | 0 |
| 144 | 201 | 0 | 228 | 0 |
| 145 | 203 | 0 | 228 | 0 |
| 146 | 204 | 0 | 229 | 0 |
| 147 | 204 | 0 | 229 | 0 |
| 148 | 205 | 0 | 229 | 0 |
| 149 | 206 | 0 | 230 | 0 |
| 150 | 207 | 0 | 230 | 0 |
| 151 | 208 | 0 | 231 | 0 |
| 152 | 209 | 0 | 232 | 0 |
| 153 | 210 | 0 | 232 | 0 |
| 154 | 211 | 0 | 233 | 0 |
| 155 | 212 | 0 | 233 | 0 |
| 156 | 213 | 0 | 234 | 0 |
| 157 | 214 | 0 | 234 | 0 |
| 158 | 215 | 0 | 235 | 0 |
| 159 | 216 | 0 | 236 | 0 |
| 160 | 217 | 0 | 236 | 0 |
| 161 | 219 | 0 | 237 | 0 |
| 162 | 220 | 0 | 238 | 0 |
| 163 | 221 | 0 | 238 | 0 |
| 164 | 222 | 0 | 239 | 0 |
| 165 | 223 | 0 | 240 | 0 |
| 166 | 225 | 0 | 240 | 0 |
| 167 | 226 | 0 | 241 | 0 |
| 168 | 228 | 0 | 242 | 0 |
| 169 | 230 | 0 | 243 | 0 |
| 170 | 232 | 0 | 244 | 0 |
| 171 | 235 | 0 | 246 | 0 |
| 172 | 238 | 1 | 247 | 0 |
| 173 | 241 | 1 | 249 | 0 |
| 174 | 245 | 2 | 251 | 0 |
| 175 | 249 | 3 | 253 | 0 |
| 176 | 251 | 3 | 254 | 0 |
| 177 | 252 | 4 | 254 | 0 |
| 178 | 253 | 5 | 255 | 0 |
| 179 | 254 | 5 | 255 | 0 |
| 180 | 255 | 5 | 255 | 0 |
| 181 | 255 | 6 | 255 | 0 |
| 182 | 255 | 7 | 255 | 0 |
| 183 | 255 | 7 | 255 | 0 |
| 184 | 255 | 8 | 255 | 0 |
| 185 | 255 | 9 | 255 | 0 |
| 186 | 255 | 11 | 255 | 0 |
| 187 | 255 | 14 | 255 | 0 |
| 188 | 255 | 19 | 255 | 0 |
| 189 | 255 | 29 | 255 | 0 |
| 190 | 255 | 40 | 255 | 1 |
| 191 | 255 | 51 | 255 | 2 |
| 192 | 255 | 60 | 255 | 3 |
| 193 | 255 | 67 | 255 | 4 |
| 194 | 255 | 72 | 255 | 4 |
| 195 | 255 | 77 | 255 | 5 |
| 196 | 255 | 81 | 255 | 5 |
| 197 | 255 | 85 | 255 | 6 |
| 198 | 255 | 88 | 255 | 7 |
| 199 | 255 | 91 | 255 | 8 |
| 200 | 255 | 94 | 255 | 9 |
| 201 | 255 | 98 | 255 | 11 |
| 202 | 255 | 101 | 255 | 13 |
| 203 | 255 | 105 | 255 | 17 |
| 204 | 255 | 109 | 255 | 21 |
| 205 | 255 | 114 | 255 | 27 |
| 206 | 255 | 119 | 255 | 33 |
| 207 | 255 | 123 | 255 | 39 |
| 208 | 255 | 128 | 255 | 46 |
| 209 | 255 | 132 | 255 | 53 |
| 210 | 255 | 137 | 255 | 62 |

| INPUT TONES | LUTa | LUTb | LUTc | LUTd |
|---|---|---|---|---|
| 211 | 255 | 140 | 255 | 68 |
| 212 | 255 | 143 | 255 | 74 |
| 213 | 255 | 147 | 255 | 81 |
| 214 | 255 | 151 | 255 | 87 |
| 215 | 255 | 154 | 255 | 92 |
| 216 | 255 | 156 | 255 | 97 |
| 217 | 255 | 160 | 255 | 103 |
| 218 | 255 | 163 | 255 | 109 |
| 219 | 255 | 166 | 255 | 114 |
| 220 | 255 | 168 | 255 | 119 |
| 221 | 255 | 171 | 255 | 124 |
| 222 | 255 | 174 | 255 | 128 |
| 223 | 255 | 176 | 255 | 134 |
| 224 | 255 | 179 | 255 | 139 |
| 225 | 255 | 182 | 255 | 144 |
| 226 | 255 | 185 | 255 | 149 |
| 227 | 255 | 187 | 255 | 154 |
| 228 | 255 | 189 | 255 | 159 |
| 229 | 255 | 191 | 255 | 163 |
| 230 | 255 | 194 | 255 | 167 |
| 231 | 255 | 195 | 255 | 171 |
| 232 | 255 | 197 | 255 | 175 |
| 233 | 255 | 199 | 255 | 179 |
| 234 | 255 | 202 | 255 | 183 |
| 235 | 255 | 204 | 255 | 187 |
| 236 | 255 | 205 | 255 | 190 |
| 237 | 255 | 207 | 255 | 194 |
| 238 | 255 | 209 | 255 | 197 |
| 239 | 255 | 211 | 255 | 200 |
| 240 | 255 | 213 | 255 | 202 |
| 241 | 255 | 214 | 255 | 205 |
| 242 | 255 | 216 | 255 | 208 |
| 243 | 255 | 218 | 255 | 211 |
| 244 | 255 | 220 | 255 | 213 |
| 245 | 255 | 222 | 255 | 217 |
| 246 | 255 | 224 | 255 | 219 |
| 247 | 255 | 227 | 255 | 222 |
| 248 | 255 | 229 | 255 | 225 |
| 249 | 255 | 232 | 255 | 229 |
| 250 | 255 | 235 | 255 | 232 |
| 251 | 255 | 237 | 255 | 236 |
| 252 | 255 | 240 | 255 | 239 |
| 253 | 255 | 244 | 255 | 243 |
| 254 | 255 | 248 | 255 | 247 |
| 255 | 255 | 252 | 255 | 252 |

Fig. 12

| INPUT TONES | LUTa | LUTb | LUTc | LUTd |
|---|---|---|---|---|
| 0 | 0 | 0 | 0 | 0 |
| 1 | 2 | 0 | 4 | 1 |
| 2 | 11 | 0 | 22 | 5 |
| 3 | 18 | 0 | 35 | 6 |
| 4 | 24 | 0 | 46 | 7 |
| 5 | 28 | 0 | 53 | 7 |
| 6 | 32 | 0 | 59 | 8 |
| 7 | 34 | 0 | 63 | 8 |
| 8 | 36 | 0 | 67 | 8 |
| 9 | 38 | 0 | 71 | 9 |
| 10 | 40 | 0 | 73 | 9 |
| 11 | 41 | 0 | 75 | 9 |
| 12 | 43 | 0 | 78 | 9 |
| 13 | 45 | 0 | 79 | 9 |
| 14 | 47 | 0 | 81 | 9 |
| 15 | 48 | 0 | 83 | 9 |
| 16 | 50 | 0 | 84 | 9 |
| 17 | 51 | 0 | 86 | 9 |
| 18 | 53 | 0 | 87 | 10 |
| 19 | 54 | 0 | 89 | 10 |
| 20 | 56 | 0 | 90 | 10 |
| 21 | 58 | 0 | 91 | 10 |
| 22 | 60 | 0 | 92 | 10 |
| 23 | 61 | 0 | 94 | 10 |
| 24 | 63 | 0 | 95 | 10 |
| 25 | 64 | 0 | 96 | 10 |
| 26 | 66 | 0 | 97 | 10 |
| 27 | 67 | 0 | 98 | 11 |
| 28 | 68 | 0 | 99 | 11 |
| 29 | 69 | 0 | 99 | 11 |
| 30 | 71 | 0 | 101 | 11 |
| 31 | 72 | 0 | 102 | 11 |
| 32 | 72 | 0 | 102 | 11 |
| 33 | 73 | 0 | 103 | 12 |
| 34 | 74 | 0 | 104 | 12 |
| 35 | 75 | 0 | 105 | 12 |
| 36 | 76 | 0 | 106 | 12 |
| 37 | 77 | 0 | 107 | 13 |
| 38 | 79 | 0 | 108 | 13 |
| 39 | 80 | 0 | 109 | 13 |
| 40 | 81 | 0 | 109 | 14 |
| 41 | 82 | 0 | 110 | 14 |
| 42 | 84 | 0 | 111 | 14 |
| 43 | 85 | 0 | 111 | 15 |
| 44 | 86 | 0 | 112 | 15 |
| 45 | 88 | 0 | 113 | 15 |
| 46 | 89 | 0 | 113 | 16 |
| 47 | 90 | 0 | 114 | 16 |
| 48 | 92 | 0 | 114 | 17 |
| 49 | 93 | 0 | 115 | 17 |
| 50 | 94 | 0 | 115 | 18 |
| 51 | 96 | 0 | 116 | 18 |
| 52 | 97 | 0 | 116 | 19 |
| 53 | 98 | 0 | 117 | 20 |
| 54 | 100 | 0 | 118 | 20 |
| 55 | 101 | 0 | 118 | 21 |
| 56 | 102 | 0 | 119 | 22 |
| 57 | 104 | 0 | 120 | 23 |
| 58 | 105 | 0 | 120 | 24 |
| 59 | 106 | 0 | 121 | 25 |
| 60 | 108 | 0 | 121 | 26 |
| 61 | 109 | 0 | 122 | 27 |
| 62 | 110 | 0 | 123 | 28 |
| 63 | 112 | 0 | 123 | 29 |
| 64 | 113 | 0 | 124 | 30 |
| 65 | 114 | 0 | 125 | 30 |
| 66 | 115 | 0 | 126 | 31 |
| 67 | 116 | 0 | 126 | 32 |
| 68 | 118 | 0 | 127 | 32 |
| 69 | 119 | 0 | 128 | 33 |
| 70 | 121 | 0 | 129 | 33 |

| INPUT TONES | LUTa | LUTb | LUTc | LUTd |
|---|---|---|---|---|
| 71 | 122 | 0 | 130 | 34 |
| 72 | 124 | 0 | 131 | 35 |
| 73 | 125 | 0 | 131 | 35 |
| 74 | 127 | 0 | 132 | 36 |
| 75 | 128 | 0 | 133 | 37 |
| 76 | 130 | 0 | 134 | 38 |
| 77 | 132 | 0 | 135 | 39 |
| 78 | 134 | 0 | 136 | 40 |
| 79 | 136 | 0 | 137 | 41 |
| 80 | 138 | 0 | 137 | 42 |
| 81 | 140 | 0 | 138 | 42 |
| 82 | 142 | 0 | 139 | 43 |
| 83 | 144 | 0 | 140 | 44 |
| 84 | 146 | 0 | 141 | 45 |
| 85 | 147 | 0 | 142 | 46 |
| 86 | 149 | 0 | 143 | 47 |
| 87 | 151 | 0 | 144 | 48 |
| 88 | 153 | 0 | 145 | 49 |
| 89 | 155 | 0 | 145 | 50 |
| 90 | 157 | 0 | 146 | 51 |
| 91 | 159 | 0 | 147 | 53 |
| 92 | 161 | 0 | 149 | 54 |
| 93 | 163 | 0 | 149 | 56 |
| 94 | 164 | 0 | 150 | 57 |
| 95 | 166 | 0 | 151 | 58 |
| 96 | 168 | 0 | 152 | 60 |
| 97 | 170 | 0 | 153 | 61 |
| 98 | 172 | 0 | 154 | 63 |
| 99 | 174 | 0 | 155 | 64 |
| 100 | 176 | 0 | 155 | 66 |
| 101 | 177 | 0 | 156 | 67 |
| 102 | 179 | 0 | 157 | 68 |
| 103 | 181 | 0 | 158 | 69 |
| 104 | 182 | 0 | 159 | 70 |
| 105 | 184 | 0 | 160 | 72 |
| 106 | 186 | 0 | 161 | 73 |
| 107 | 187 | 0 | 162 | 73 |
| 108 | 189 | 0 | 164 | 75 |
| 109 | 190 | 0 | 165 | 76 |
| 110 | 191 | 0 | 166 | 77 |
| 111 | 192 | 0 | 167 | 78 |
| 112 | 193 | 0 | 168 | 79 |
| 113 | 194 | 0 | 169 | 80 |
| 114 | 195 | 0 | 170 | 81 |
| 115 | 196 | 0 | 171 | 82 |
| 116 | 196 | 0 | 172 | 83 |
| 117 | 197 | 0 | 173 | 84 |
| 118 | 198 | 0 | 174 | 86 |
| 119 | 198 | 0 | 175 | 87 |
| 120 | 199 | 0 | 176 | 88 |
| 121 | 199 | 0 | 176 | 89 |
| 122 | 200 | 0 | 177 | 91 |
| 123 | 201 | 0 | 178 | 92 |
| 124 | 201 | 0 | 179 | 93 |
| 125 | 202 | 0 | 180 | 94 |
| 126 | 202 | 0 | 181 | 96 |
| 127 | 203 | 0 | 182 | 97 |
| 128 | 204 | 0 | 183 | 98 |
| 129 | 204 | 0 | 184 | 99 |
| 130 | 205 | 0 | 185 | 100 |
| 131 | 205 | 0 | 185 | 101 |
| 132 | 206 | 0 | 186 | 102 |
| 133 | 206 | 0 | 187 | 103 |
| 134 | 207 | 0 | 188 | 104 |
| 135 | 208 | 0 | 188 | 105 |
| 136 | 208 | 0 | 189 | 106 |
| 137 | 209 | 0 | 190 | 106 |
| 138 | 209 | 0 | 190 | 107 |
| 139 | 210 | 0 | 191 | 108 |
| 140 | 211 | 0 | 192 | 109 |

Fig. 13

| INPUT TONES | LUTa | LUTb | LUTc | LUTd |
|---|---|---|---|---|
| 141 | 211 | 0 | 192 | 109 |
| 142 | 212 | 0 | 193 | 110 |
| 143 | 213 | 0 | 193 | 111 |
| 144 | 214 | 0 | 194 | 111 |
| 145 | 214 | 0 | 194 | 112 |
| 146 | 215 | 0 | 195 | 112 |
| 147 | 216 | 0 | 195 | 113 |
| 148 | 217 | 0 | 196 | 113 |
| 149 | 217 | 0 | 196 | 114 |
| 150 | 218 | 0 | 197 | 114 |
| 151 | 219 | 0 | 197 | 115 |
| 152 | 220 | 0 | 198 | 116 |
| 153 | 220 | 0 | 198 | 116 |
| 154 | 221 | 0 | 198 | 117 |
| 155 | 222 | 0 | 199 | 117 |
| 156 | 223 | 0 | 199 | 118 |
| 157 | 223 | 0 | 200 | 119 |
| 158 | 224 | 0 | 200 | 119 |
| 159 | 225 | 0 | 201 | 120 |
| 160 | 226 | 0 | 201 | 121 |
| 161 | 227 | 0 | 201 | 122 |
| 162 | 228 | 0 | 202 | 122 |
| 163 | 229 | 0 | 202 | 123 |
| 164 | 230 | 0 | 203 | 124 |
| 165 | 231 | 0 | 203 | 125 |
| 166 | 232 | 0 | 203 | 126 |
| 167 | 233 | 0 | 204 | 127 |
| 168 | 234 | 0 | 204 | 128 |
| 169 | 235 | 0 | 204 | 129 |
| 170 | 236 | 0 | 205 | 130 |
| 171 | 237 | 0 | 205 | 130 |
| 172 | 238 | 0 | 206 | 131 |
| 173 | 239 | 0 | 206 | 132 |
| 174 | 241 | 0 | 206 | 133 |
| 175 | 242 | 0 | 207 | 134 |
| 176 | 244 | 0 | 207 | 134 |
| 177 | 245 | 0 | 208 | 135 |
| 178 | 247 | 0 | 208 | 136 |
| 179 | 248 | 1 | 208 | 137 |
| 180 | 249 | 1 | 209 | 138 |
| 181 | 251 | 2 | 209 | 140 |
| 182 | 252 | 3 | 209 | 141 |
| 183 | 253 | 3 | 209 | 142 |
| 184 | 253 | 4 | 210 | 143 |
| 185 | 254 | 5 | 210 | 144 |
| 186 | 254 | 6 | 210 | 145 |
| 187 | 255 | 7 | 210 | 146 |
| 188 | 255 | 8 | 210 | 147 |
| 189 | 255 | 9 | 210 | 149 |
| 190 | 255 | 11 | 210 | 150 |
| 191 | 255 | 14 | 210 | 152 |
| 192 | 255 | 17 | 210 | 154 |
| 193 | 255 | 21 | 210 | 156 |
| 194 | 255 | 26 | 210 | 158 |
| 195 | 255 | 33 | 210 | 161 |
| 196 | 255 | 39 | 210 | 164 |
| 197 | 255 | 46 | 211 | 166 |
| 198 | 255 | 52 | 211 | 168 |
| 199 | 255 | 59 | 211 | 170 |
| 200 | 255 | 65 | 211 | 173 |
| 201 | 255 | 71 | 211 | 174 |
| 202 | 255 | 77 | 211 | 176 |
| 203 | 255 | 82 | 211 | 178 |
| 204 | 255 | 87 | 212 | 179 |
| 205 | 255 | 92 | 212 | 181 |
| 206 | 255 | 97 | 212 | 183 |
| 207 | 255 | 101 | 212 | 185 |
| 208 | 255 | 105 | 213 | 186 |
| 209 | 255 | 110 | 213 | 188 |
| 210 | 255 | 114 | 213 | 189 |

| INPUT TONES | LUTa | LUTb | LUTc | LUTd |
|---|---|---|---|---|
| 211 | 255 | 117 | 214 | 190 |
| 212 | 255 | 121 | 214 | 191 |
| 213 | 255 | 125 | 214 | 193 |
| 214 | 255 | 128 | 215 | 194 |
| 215 | 255 | 132 | 215 | 196 |
| 216 | 255 | 136 | 215 | 197 |
| 217 | 255 | 139 | 216 | 198 |
| 218 | 255 | 143 | 216 | 199 |
| 219 | 255 | 147 | 217 | 201 |
| 220 | 255 | 151 | 217 | 202 |
| 221 | 255 | 154 | 218 | 203 |
| 222 | 255 | 158 | 219 | 204 |
| 223 | 255 | 161 | 219 | 206 |
| 224 | 255 | 164 | 220 | 207 |
| 225 | 255 | 168 | 220 | 208 |
| 226 | 255 | 171 | 221 | 209 |
| 227 | 255 | 174 | 221 | 210 |
| 228 | 255 | 177 | 222 | 212 |
| 229 | 255 | 180 | 223 | 213 |
| 230 | 255 | 183 | 223 | 214 |
| 231 | 255 | 185 | 224 | 215 |
| 232 | 255 | 188 | 225 | 216 |
| 233 | 255 | 191 | 225 | 217 |
| 234 | 255 | 193 | 226 | 219 |
| 235 | 255 | 196 | 227 | 220 |
| 236 | 255 | 198 | 228 | 221 |
| 237 | 255 | 201 | 229 | 222 |
| 238 | 255 | 203 | 230 | 224 |
| 239 | 255 | 205 | 230 | 225 |
| 240 | 255 | 208 | 232 | 226 |
| 241 | 255 | 210 | 233 | 228 |
| 242 | 255 | 212 | 234 | 229 |
| 243 | 255 | 214 | 235 | 231 |
| 244 | 255 | 217 | 236 | 232 |
| 245 | 255 | 219 | 237 | 234 |
| 246 | 255 | 222 | 238 | 235 |
| 247 | 255 | 225 | 240 | 237 |
| 248 | 255 | 228 | 241 | 239 |
| 249 | 255 | 230 | 243 | 241 |
| 250 | 255 | 233 | 244 | 242 |
| 251 | 255 | 237 | 246 | 245 |
| 252 | 255 | 240 | 248 | 247 |
| 253 | 255 | 243 | 249 | 249 |
| 254 | 255 | 247 | 251 | 251 |
| 255 | 255 | 251 | 254 | 253 |

LCD DEVICE AND TELEVISION RECEIVER

REFERENCE TO RELATED APPLICATIONS

This application is a national stage application under 35 USC 371 of International Application No. PCT/JP2010/065341, filed Sep. 7, 2010, which claims priority from Japanese Patent Application No. 2009-270816, filed Nov. 27, 2009, the entire contents of which are incorporated herein by reference.

FIELD OF THE INVENTION

The present invention relates to a display device that carries out a single halftone display with a temporal change in pixel luminance.

BACKGROUND OF THE INVENTION

There is proposed a technique for improving the viewing angle characteristic of a liquid crystal display device by carrying out a single halftone display with a temporal change in pixel luminance (e.g., see Patent Literature 1). In this case, a single halftone is displayed, for example, by supplying pixels of a first type with a data voltage corresponding to a tone of X during the first and second frame periods and with a data voltage corresponding to a tone of Y (Y>X) during the third and fourth frame periods and, meanwhile, supplying pixels of a second type with a data voltage corresponding to a tone of Y during the first and second frame periods and with a data voltage corresponding to a tone of X during the third and fourth frame periods.

Japanese Patent Application Publication, Tokukaihei, No. 7-121144 (Publication Date: May 12, 1995)

SUMMARY OF INVENTION

However, when each pixel is supplied with a data voltage as described above, the following problem arises: Even in the case of an identical halftone inputted to the first and second types of pixels (e.g., in the case of a solid display), a superimposed wave of a wave of response of the pixels of the first type (change in transmittance over time) and a wave of response of the pixels of the second type (change in transmittance over time) does not take a near-flat waveform, as shown in (a) and (b) of FIG. 19, with the result that flickers cannot be sufficiently suppressed.

It is an object of the present invention to achieve both an improvement in viewing angle characteristic of a liquid crystal display device and a reduction in flickers in the liquid crystal display device.

A liquid crystal display device according to the present invention is a liquid crystal display device which carries out a single tone display with a change in pixel luminance during a single cycle composed of first to mth frame periods (m is an integer of 4 or more), including: pixels of a first type in which when a halftone is displayed, supply of two or more kinds of data voltage during at least either the first to nth frame periods (n is an integer of 2 or more to m or less) or the (n+1)th to mth frame periods causes liquid crystal layers to produce rise responses during the first to nth frame periods and produce decay responses during the (n+1)th to mth frame periods; and pixels of a second type in which when a halftone is displayed, supply of two or more kinds of data voltage during at least either the first to nth frame periods or the (n+1)th to mth frame periods causes liquid crystal layers to produce decay responses during the first to nth frame periods and produce rise responses during the (n+1)th to mth frame periods.

By thus supplying the pixels of each type with two kinds of data voltage (a plurality of data voltages of different magnitudes) during at least either the first to nth frame periods (n is an integer of 2 or more to m or less) or the (n+1)th to mth frame periods, adjustment of a wave of response of the pixels of each type is made possible, for example, so that a wave of response during a single cycle in the pixels of the first type and a wave of response during a single cycle in the pixels of the second type can be made substantially symmetrical with each other about a line. This allows a superimposed wave of a wave of response of the pixels of the first type and a wave of response of the pixels of the second type to take a near-flat waveform, thus making it possible to sufficiently suppress flickers.

The liquid crystal display device according to the present invention may be configured such that the data voltages that are supplied to the pixels of the first and second types when a halftone is displayed are set so that a wave of response during a single cycle in the pixels of each of the first and second types is substantially a rectangular wave or a trapezoidal wave.

The liquid crystal display device according to the present invention may be configured such that the data voltages that are supplied to the pixels of the first and second types when a halftone is displayed are set so that a wave of response during a single cycle in the pixels of each of the first and second types is substantially a triangular wave or a sinusoidal wave.

The liquid crystal display device according to the present invention may be configured such that while a halftone is displayed in the pixels of the first type by, during the first to nth frame periods, supplying a data voltage corresponding to a relatively low tone after having supplied a data voltage corresponding to a relatively high tone, a halftone is displayed in the pixels of the second type by, during the (n+1)th to mth frame periods, supplying a data voltage corresponding to a relatively low tone after having supplied a data voltage corresponding to a relatively high tone.

The liquid crystal display device according to the present invention may be configured such that while a halftone at a predetermined tone or higher is displayed in the pixels of the first type by, during the first to nth frame periods, supplying a data voltage corresponding to a relatively high tone after having supplied a data voltage corresponding to a relatively low tone and by, during the (n+1)th to mth frame periods, supplying a data voltage corresponding to a relatively low tone after having supplied a data voltage corresponding to a relatively high tone, a halftone at a predetermined tone or higher is displayed in the pixels of the second type by, during the first to nth frame periods, supplying a data voltage corresponding to a relatively low tone after having supplied a data voltage corresponding to a relatively high tone and by, during the (n+1)th to mth frame periods, supplying a data voltage corresponding to a relatively high tone after having supplied a data voltage corresponding to a relatively low tone.

The liquid crystal display device according to the present invention may be configured such that while a halftone at less than a predetermined tone is displayed in the pixels of the first type by, during the first to nth frame periods, supplying a data voltage corresponding to a relatively low tone after having supplied a data voltage corresponding to a relatively high tone and by, during the (n+1)th to mth frame periods, supplying a data voltage corresponding to a relatively low tone after having supplied a data voltage corresponding to a relatively high tone, a halftone at less than a predetermined tone is displayed in the pixels of the second type by, during the first to nth frame periods, supplying a data voltage corresponding to a relatively low tone after having supplied a data voltage corresponding to a relatively high tone and by, during the (n+1)th to mth frame periods, supplying a data voltage corresponding to a relatively low tone after having supplied a data voltage corresponding to a relatively high tone.

The liquid crystal display device according to the present invention may be configured such that m=4 and n=4, or m=8 and n=4.

The liquid crystal display device according to the present invention may be configured such that: display units each composed of a plurality of pixels of different colors are arranged in row- and column-wise directions; and the plurality of pixels contained in the same display unit are of the same type.

The liquid crystal display device according to the present invention may be configured such that the type of pixels contained in one of two display units adjacent to each other in a scanning direction and the type of pixels contained in the other display unit are different from each other.

The liquid crystal display device according to the present invention may be configured such that the type of pixels contained in one of two display units adjacent to each other in a direction orthogonal to a scanning direction and the type of pixels contained in the other display unit are different from each other.

The liquid crystal display device according to the present invention may be configured such that the display units are each composed of a red pixel, a green pixel, and a blue pixel.

The liquid crystal display device according to the present invention may be configured such that the number of display units composed of the pixels of the first type and the number of display units composed of the pixels of the second type are substantially equal to each other.

The liquid crystal display device according to the present invention may be configured such that a frame frequency is 75 Hz or higher.

The liquid crystal display device according to the present invention may be configured such that each of the pixels is supplied with data potentials whose polarities are reversed every frame.

The liquid crystal display device according to the present invention may be configured such that the polarity of a data potential that is written to one of two pixels adjacent to each other in a scanning direction and the polarity of a data potential that is written to the other pixel are different from each other.

The liquid crystal display device according to the present invention may be configured such that the polarity of a data potential that is written to one of two pixels adjacent to each other in a direction orthogonal to a scanning direction and the polarity of a data potential that is written to the other pixel are different from each other.

The liquid crystal display device according to the present invention may be configured such that assuming a scanning direction is a column-wise direction, each column of pixels is provided with two data signal lines corresponding thereto, and two pixels adjacent to each other in the column-wise direction are connected to different data signal lines via transistors, so that two scanning signal lines are selected at a time.

The liquid crystal display device according to the present invention may be configured such that the two data signal lines provided in correspondence with each column of pixels are provided with data potentials of opposite polarities.

A liquid crystal display device according to the present invention is a liquid crystal display device which carries out a single tone display with a change in pixel luminance during a single cycle composed of first to mth frame periods (m is an integer of 4 or more), including: pixels of a first type in which when a plurality of identical halftones are continuously displayed, liquid crystal layers produce rise responses during the first to nth frame periods and produce decay responses during the (n+1)th to mth frame periods; and pixels of a second type in which when the plurality of identical halftones are continuously displayed, liquid crystal layers produce decay responses during the first to nth frame periods and produce rise responses during the (n+1)th to mth frame periods, when the plurality of identical halftones are continuously displayed in the pixels of the first and second types, a plurality of effective voltages of different magnitudes being applied to the pixels of the first type by supplying the pixels of the first type with two or more kinds of data voltage during at least either the first to nth frame periods or the (n+1)th to mth frame periods and a plurality of effective voltages of different magnitudes being applied to the pixels of the second type by supplying the pixels of the second type with two or more kinds of data voltage during at least either the first to nth frame periods or the (n+1)th to mth frame periods, so that a sum of luminance of the pixels of the first and second types becomes steady.

The present application assumes that an effective potential (having a polarity) is a potential obtained by subtracting, from a data potential (having a polarity) that is supplied to a pixel from a data signal line, a voltage pulled in when the transistor was OFF, that a data voltage is a potential difference (nonpolar value representing only magnitude absolute value) between a data potential and a reference potential (Vcom), and that an effective voltage (nonpolar value representing only magnitude=absolute value) is a potential difference (voltage that is actually applied to the pixel) between the effective potential and the reference potential (Vcom).

A television receiver includes: the liquid crystal display device; and a tuner section, which receives a television broadcast.

As described above, a liquid crystal display device of the present invention can achieve both an improvement in viewing angle characteristic and a reduction in flickers.

BRIEF DESCRIPTION OF DRAWINGS

FIG. 6 is a table showing an example of correspondence between input tones (tones of 0 to 140) and output tones of LUTa to LUTd.

FIG. 7 is a table showing an example of correspondence between input tones (tones of 141 to 255) and output tones of LUTa to LUTd.

FIG. 12 is a table showing another example of correspondence between input tones (tones of 0 to 140) and output tones of LUTa to LUTd.

FIG. 13 is a table showing another example of correspondence between input tones (tones of 141 to 255) and output tones of LUTa to LUTd.

DETAILED DESCRIPTION OF THE INVENTION

Embodiment 1

Figure 1:
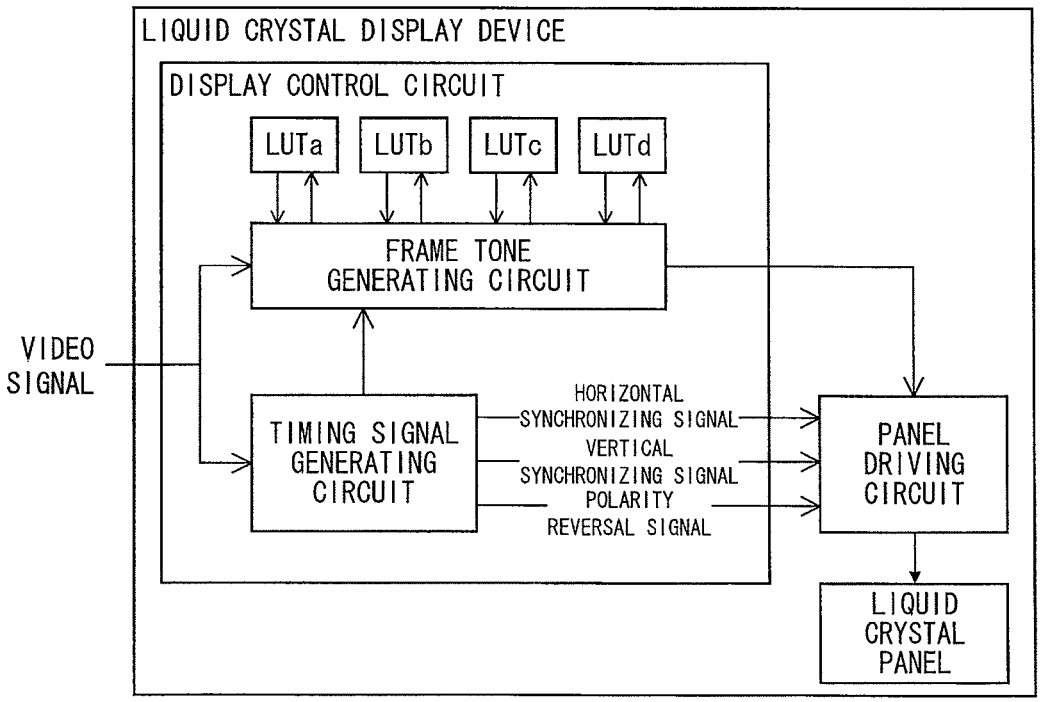
FIG. 1 is a block diagram showing a configuration of a liquid crystal display device according to an embodiment of the present invention.
Figure 2:
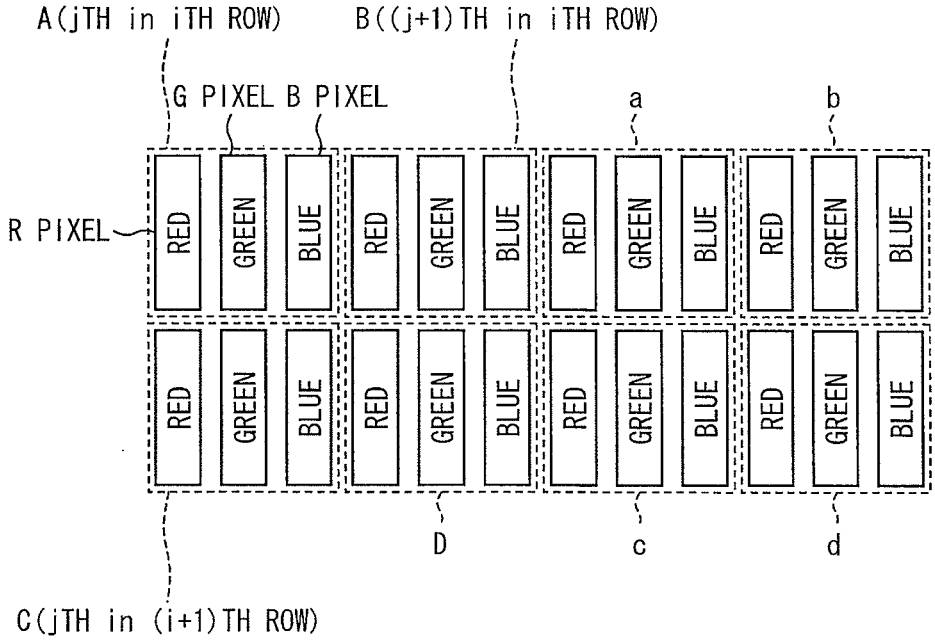
FIG. 2 is a schematic view showing an arrangement of 24 pixels contained in eight display units (A to D and a to d) of a liquid crystal panel.

An embodiment of the present invention is described below with reference to FIGS. 1 through 18. FIG. 1 is a block diagram showing a configuration of a liquid crystal display device according to the present embodiment. As shown in FIG. 1, the liquid crystal display device according to the present embodiment is a liquid crystal display device which carries out a single tone display with a change in pixel luminance during a single cycle composed of first to mth frame periods (m is an integer of 4 or more), and includes a liquid crystal panel, a panel driving circuit, and a display control circuit. The liquid crystal panel includes: a plurality of scanning signal lines; a plurality of data signal lines; and a plurality of display units arranged in a row-wise direction (direction orthogonal to a scanning direction) and a column-wise direction (scanning direction). As shown in FIG. 2, each of the display units is composed of an R pixel, a G pixel, and a B pixel arranged in the row-wise direction. The following description assumes that the jth display unit in the ith row is a display unit A, that the (j+1)th display unit in the ith row is a display unit B, that the jth display unit in the (i+1)th row is a display unit C, that the (j+1)th display unit in the (i+1)th row is a display unit D, that the (j+2)th display unit in the ith row is a display unit a, that the (j+3)th display unit in the ith row is a display unit b, that the (j+2)th display unit in the (i+1)th row is a display unit c, and that the (j+3)th display unit in the (i+1)th row is a display unit d. The panel driving circuit includes: a source driver, which drives the data signal lines; and a gate driver, which drives the scanning signal line. The display control circuit includes a timing signal generating circuit, a frame tone generating circuit, and LUTs (look-up tables) a to LUTd.

The timing signal generating circuit generates a horizontal synchronizing signal, a vertical synchronizing signal, and a polarity reversal signal in accordance with an incoming video signal, and sends the horizontal synchronizing signal, the vertical synchronizing signal, and the polarity reversal signal to the panel driving circuit.

The frame tone generating circuit generates, by using the LUTa to LUTd, frame tone data (hereinafter abbreviated as "frame tones") corresponding to tone data (hereinafter abbreviated as "input tones") represented by the incoming video signal. For example, in the case of a single cycle composed of four frames (of a single tone display being carried out with a change in pixel luminance during a single cycle composed of first to fourth frame periods), the frame tone generating circuit generates four frame tones with respect to a single input tone. Specifically, the frame tone generating circuit generates first to fourth frame tones corresponding to pixels of a first type and first to fourth frame tones corresponding to pixels of a second type.

As for each of the display units shown in FIG. 2, for example, those pixels (red, green, blue) which belong to the display units A and D are of the first type, and those pixels (red, green, blue) which belong to the display units B and C are of the second type.

Then, the panel driving circuit drives the data signal lines and the scanning signal lines in accordance with the horizontal synchronizing signal, the vertical synchronizing signal, and the polarity reversal signal generated by the timing signal generating circuit, and supplies the pixels with data voltages respectively corresponding to the first to fourth frame tones generated by the frame tone generating circuit. Although it is preferable that the drive frequency (frame frequency=rewrite frequency) be in the range of a double speed of 120 Hz to a quadruple speed of 240 Hz, this does not imply any limitation.

Figure 3:
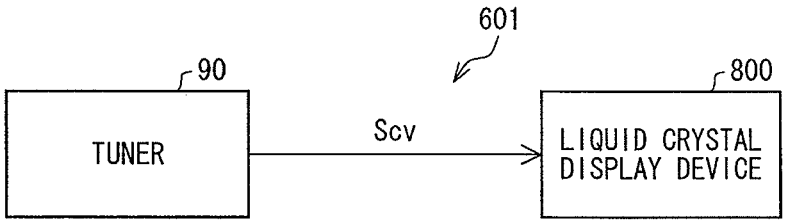
FIG. 3 is a block diagram showing a configuration of a television receiver according to an embodiment of the present invention.

In the case of the liquid crystal display device according to the present embodiment displaying an image based on a television broadcast, a tuner 90 is connected to the liquid crystal display device according to the present embodiment as shown in FIG. 3, whereby a television receiver 601 is constituted. This tuner 90 receives a wave through an antenna (not illustrated), takes out a (composite color) video signal Scv from the wave, and sends the video signal Scv to the liquid crystal display device according to the present embodiment.

Embodiment 1

Figure 8:
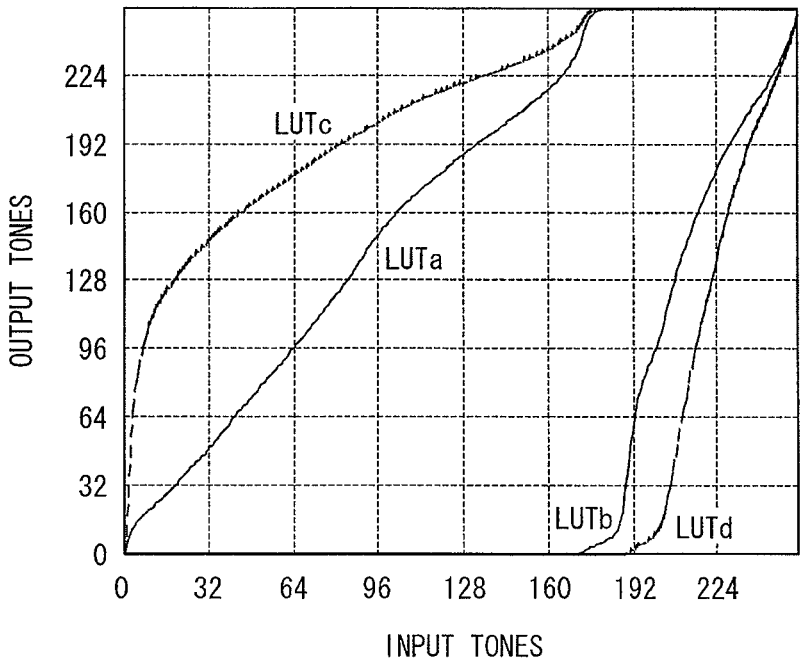
FIG. 8 is a graph of the tables shown in FIGS. 6 and 7.

Embodiment 1 assumes that the video signal is an 8-bit signal with a gray scale of 256 tones, and uses LUTa to LUTd shown in FIGS. 6 and 7. FIG. 8 is a graph of the tables shown in FIGS. 6 and 7. In the case of a tone of 125 (halftone) inputted to the pixels of the first type in Embodiment 1, the frame tone generating circuit generates a first frame tone of 219, a second frame tone of 184, a third frame tone of 0, and a fourth frame tone of 0. In the case of a tone of 125 (halftone) inputted to the pixels of the second type in Embodiment 1, the frame tone generating circuit generates a first frame tone of 0, a second frame tone of 0, a third frame tone of 219, and a fourth frame tone of 184. In the case of a tone of 200 (halftone) inputted to the pixels of the first type in Embodiment 1, the frame tone generating circuit generates a first frame tone of 255, a second frame tone of 255, a third frame tone of 9, and a fourth frame tone of 94. In the case of a tone of 200 (halftone) inputted to the pixels of the second type in Embodiment 1, the frame tone generating circuit generates a first frame tone of 9, a second frame tone of 94, a third frame tone of 255, and a fourth frame tone of 255.

Figure 4:
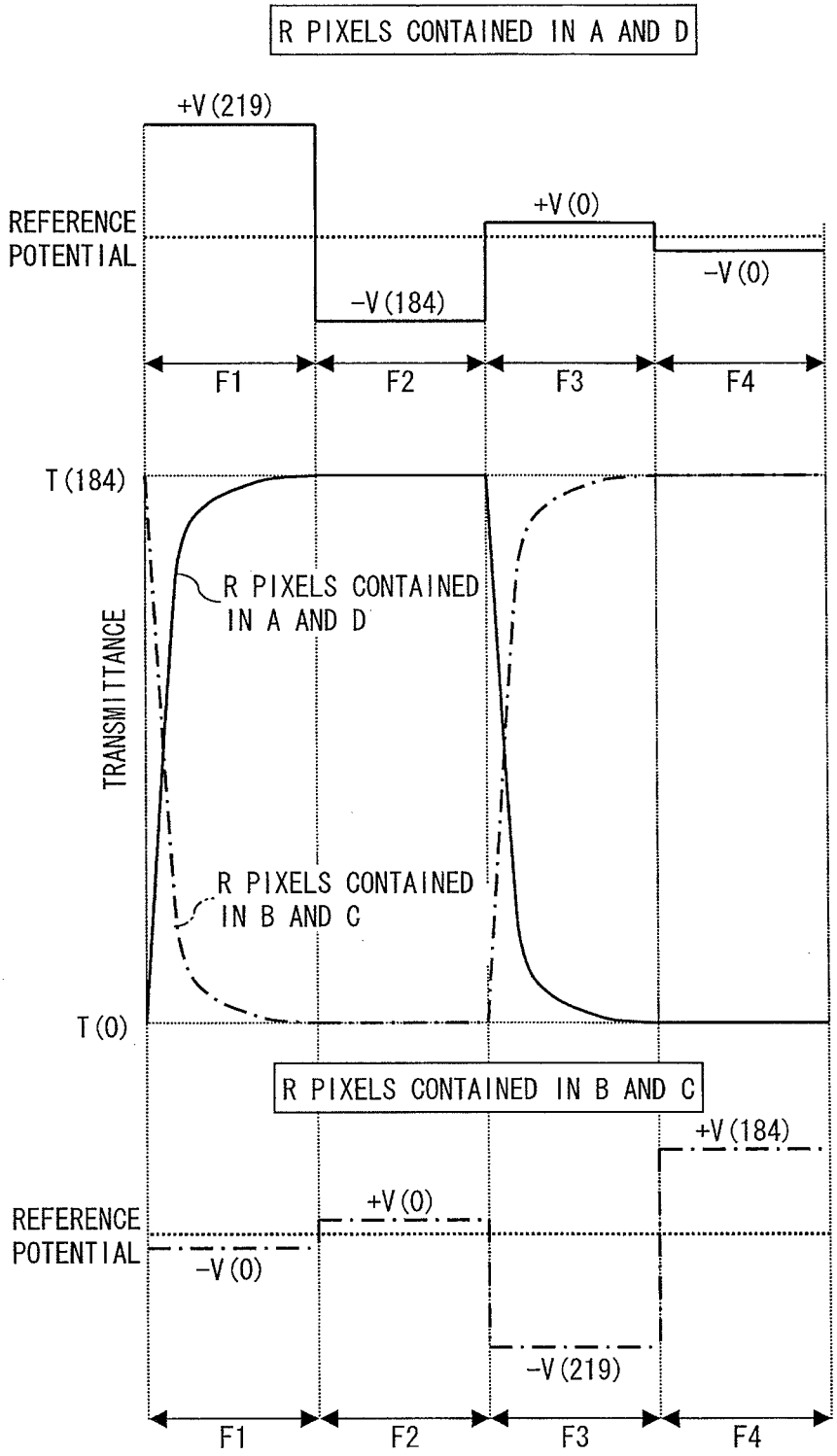
FIG. 4 is a schematic view showing an example of driving during the first frame period (F1) to the fourth frame period (F4) and waveforms of response of liquid crystals in the liquid crystal display device.

FIG. 4 is a schematic view showing an example of driving in a case where the liquid crystal display device according to Embodiment 1 carries out a solid display at a tone of 125 continuously for a certain period and waveforms of response (changes in transmittance over time). As shown in FIG. 4, the R pixels contained in the display units A and D (pixels of the first type) are supplied with a positive data potential (+V219) corresponding to a tone of 129 during the first frame period F1, a negative data potential (−V184) corresponding to a tone of 184 during the second frame period F2, a positive data potential (+V0) corresponding to a tone of 0 during the third frame period F3, and a negative data potential (−V0) corresponding to a tone of 0 during the fourth frame period F4. That is, during F1 to F2, two effective voltages of different magnitudes are applied to the R pixels contained in the display units A and D (pixels of the first type) by supplying the R pixels with two kinds of data voltage, and during F3 to F4, one effective voltage is applied to the R pixels by supplying the R pixels with one kind of data voltage, whereby the data potentials have their polarities (positive/negative) reversed every frame. Meanwhile, the R pixels contained in the display units B and C (pixels of the second type) are supplied with a negative data potential (−V0) corresponding to a tone of 0 during the first frame period F1, a positive data potential (+V0) corresponding to a tone of 0 during the second frame period F2, a negative data potential (−V219) corresponding to a tone of 219 during the third frame period F3, and a positive data potential (+V184) corresponding to a tone of 0 during the fourth frame period F4. That is, during F1 to F2, one effective voltage is applied to the R pixels contained in the display units B and C (pixels of the second type) by supplying the R pixels with one kind of data voltage, and during F3 to F4, two effective voltages of different magnitudes are applied to the R pixels by supplying the R pixels with two kinds of data voltage, whereby the data potentials have their polarities (positive/negative) reversed every frame.

According to the driving of FIG. 4, the R pixels contained in the display units A and D (pixels of the first type) are overdriven during F1, and the R pixels contained in the display units B and C (pixels of the second type) are overdriven during F3, so that as shown in FIG. 4, the waveform of response of the pixels of the first type during F1 to F4 (single cycle) and the waveform of response of the pixels of the second type during F1 to F4 (single cycle) are substantially rectangular and symmetrical with each other about a line. This allows a superimposed wave of a wave of response of the pixels of the first type and a wave of response of the pixels of the second type to take a near-flat waveform, thus making it possible to sufficiently suppress flickers. Furthermore, overdriving the pixels of the first type and the pixels of the second type causes a greater change in luminance per cycle, thus achieving a further improvement in viewing angle characteristic.

Figure 5:
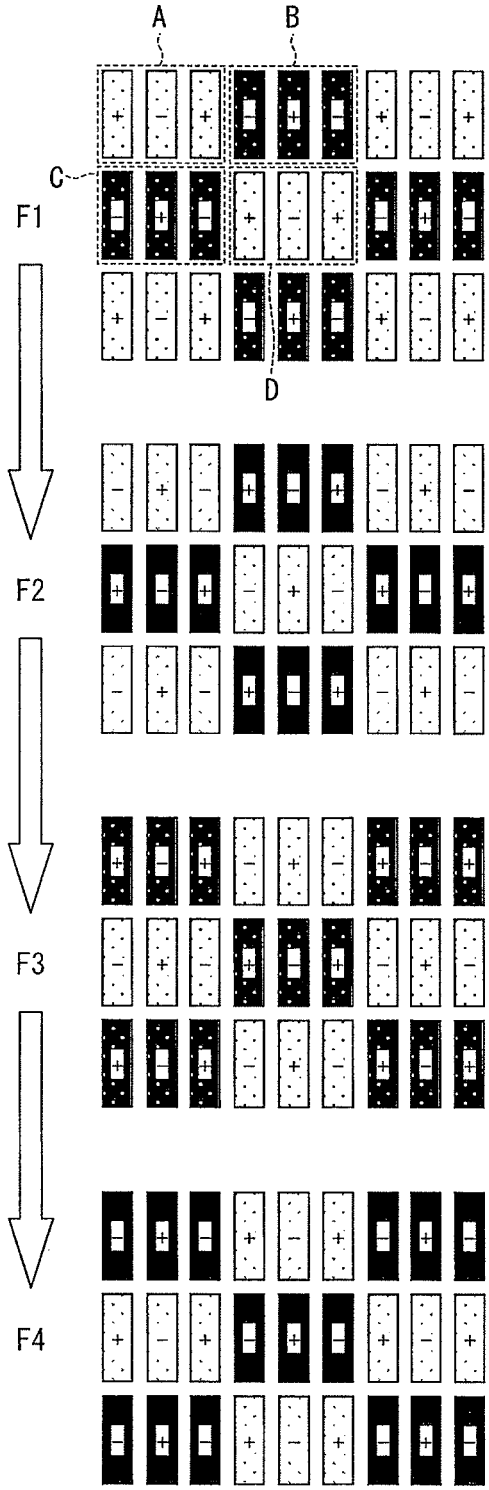
FIG. 5 is a schematic view showing a display state in the example of driving of FIG. 4.

FIG. 5 is a schematic view showing a display state of 27 pixels belonging to nine display units, including the display units A to D, in a case where the driving of FIG. 4 is carried out. As shown in FIGS. 4 and 5, in a case where the waveform of response of the pixels of the first type and the waveform of response of the pixels of the second type are rectangular, the average luminance during F1 and the average luminance during F2 are higher than the average luminance during F1 to F4 (luminance corresponding to a tone of 125) in the pixels of the first type (pixels contained in the pixel units A and D), and the average luminance during F3 and the average luminance during F4 are lower than the average luminance during F1 to F4 (luminance corresponding to a tone of 125) in the pixels of the first type. Meanwhile, the average luminance during F1 and the average luminance during F2 are lower than the average luminance during F1 to F4 (luminance corresponding to a tone of 125) in the pixels of the second type (pixels contained in the pixel units B and C), and the average luminance during F3 and the average luminance during F4 are higher than the average luminance during F1 to F4 (luminance corresponding to a tone of 125) in the pixels of the second type.

Embodiment 2

Figure 14:
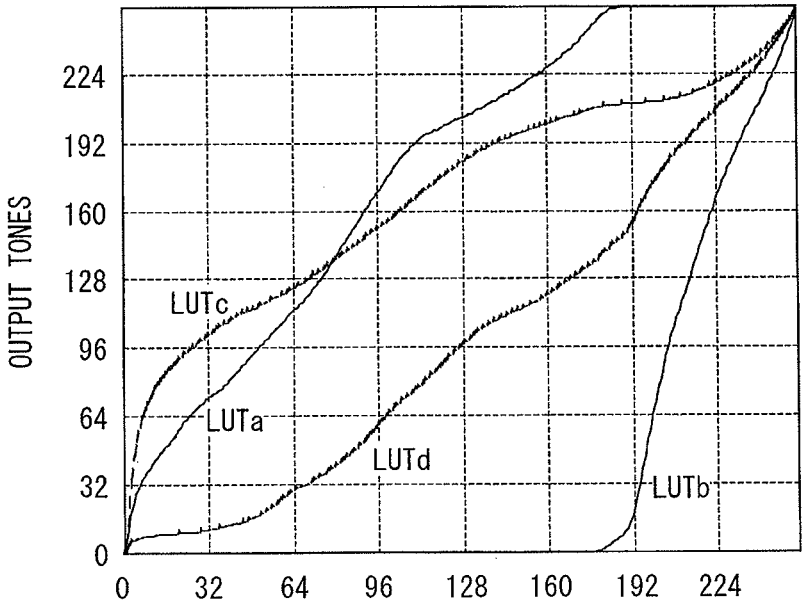
FIG. 14 is a graph pf the tables shown in FIGS. 10 and 11.

Embodiment 2 assumes that the video signal is an 8-bit signal with a gray scale of 256 tones, and uses LUTa to LUTd shown in FIGS. 12 and 13. FIG. 14 is a graph of the tables shown in FIGS. 12 and 13. In the case of a tone of 125 (halftone) inputted to the pixels of the first type in Embodiment 2, the frame tone generating circuit generates a first frame tone of 180, a second frame tone of 202, a third frame tone of 94, and a fourth frame tone of 0. In the case of a tone of 125 (halftone) inputted to the pixels of the second type in Embodiment 2, the frame tone generating circuit generates a first frame tone of 94, a second frame tone of 0, a third frame tone of 180, and a fourth frame tone of 202. In the case of a tone of 200 (halftone) inputted to the pixels of the first type in Embodiment 2, the frame tone generating circuit generates a first frame tone of 211, a second frame tone of 255, a third frame tone of 173, and a fourth frame tone of 65. In the case of a tone of 200 (halftone) inputted to the pixels of the second type in Embodiment 2, the frame tone generating circuit generates a first frame tone of 173, a second frame tone of 65, a third frame tone of 211, and a fourth frame tone of 255. Further, in the case of a tone of 70 (halftone) inputted to the pixels of the first type in Embodiment 2, the frame tone generating circuit generates a first frame tone of 129, a second frame tone of 121, a third frame tone of 33, and a fourth frame tone of 0. In the case of a tone of 70 (halftone) inputted to the pixels of the second type in Embodiment 2, the frame tone generating circuit generates a first frame tone of 33, a second frame tone of 0, a third frame tone of 129, and a fourth frame tone of 121.

Figure 9:
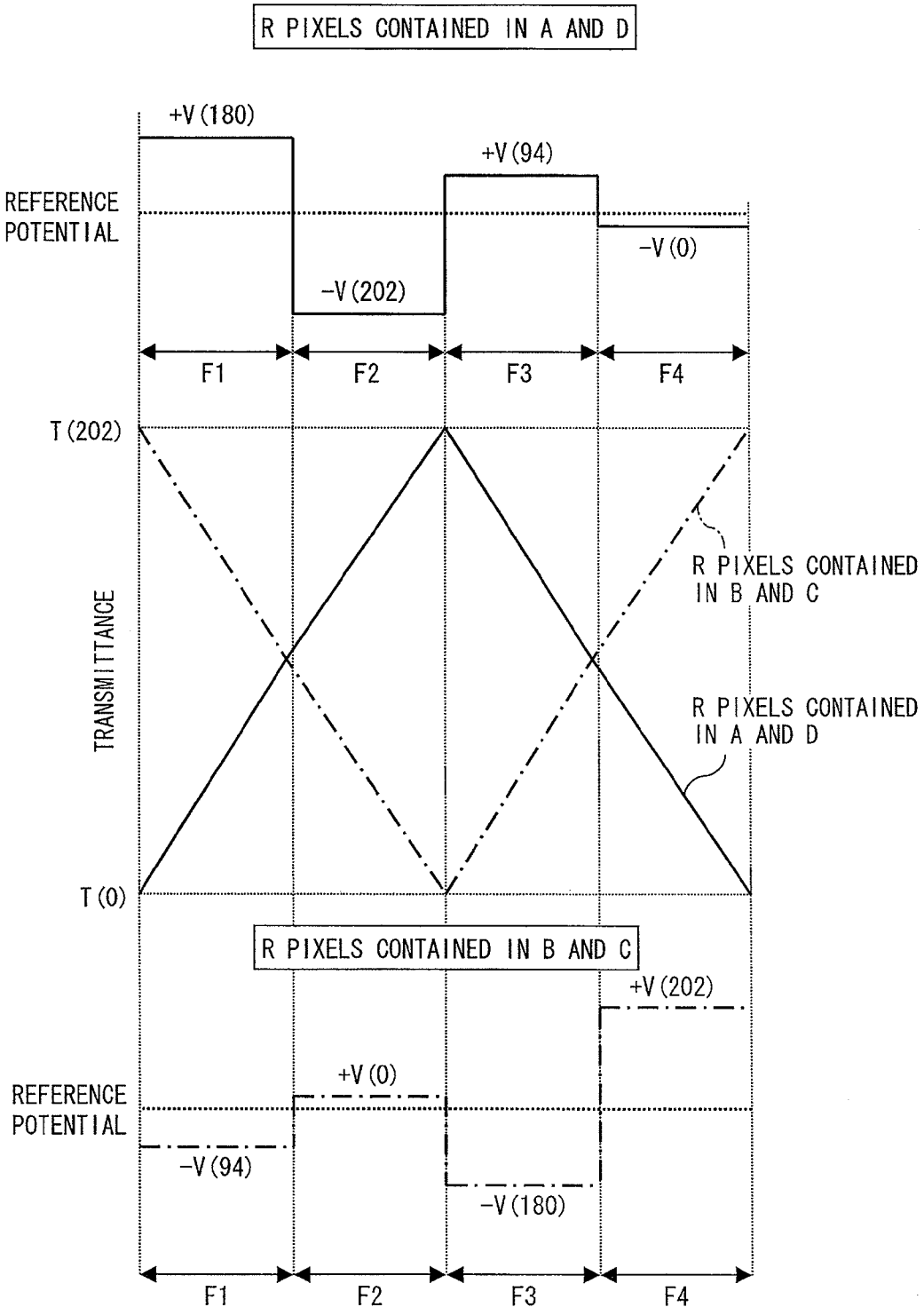
FIG. 9 is a schematic view showing an example of driving (where a tone of 125 is displayed) during the first frame period (F1) to the fourth frame period (F4) and waveforms of response of liquid crystals in the liquid crystal display device.

FIG. 9 is a schematic view showing an example of driving in a case where the liquid crystal display device according to Embodiment 2 carries out a solid display at a tone of 125 continuously for a certain period and waveforms of response (changes in transmittance over time). As shown in FIG. 9, the R pixels contained in the display units A and D (pixels of the first type) are supplied with a positive data potential (+V180) corresponding to a tone of 180 during the first frame period F1, a negative data potential (−V202) corresponding to a tone of 202 during the second frame period F2, a positive data potential (+V94) corresponding to a tone of 94 during the third frame period F3, and a negative data potential (−V0) corresponding to a tone of 0 during the fourth frame period F4. That is, during F1 to F2, two effective voltages of different magnitudes are applied to the R pixels contained in the display units A and D (pixels of the first type) by supplying the R pixels with two kinds of data voltage, and during F3 to F4, too, two effective voltages of different magnitudes are applied to the R pixels by supplying the R pixels with two kinds of data voltage. More specifically, during the first to second frame periods, a data voltage corresponding to a relatively high tone is supplied after a data voltage corresponding to a relatively low tone has been supplied, and during the third to fourth frame periods, a data voltage corresponding to a relatively low tone is supplied after a data voltage corresponding to a relatively high tone has been supplied, whereby the data potentials have their polarities (positive/negative) reversed every frame. Meanwhile, the R pixels contained in the display units B and C (pixels of the second type) are supplied with a negative data potential (−V94) corresponding to a tone of 94 during the first frame period F1, a positive data potential (+V0) corresponding to a tone of 0 during the second frame period F2, a negative data potential (−V180) corresponding to a tone of 180 during the third frame period F3, and a positive data potential (+V202) corresponding to a tone of 202 during the fourth frame period F4. That is, during F1 to F2, two effective voltages of different magnitudes are applied to the R pixels contained in the display units B and C (pixels of the second type) by supplying the R pixels with two kinds of data voltage, and during F3 to F4, too, two effective voltages of different magnitudes are applied to the R pixels by supplying the R pixels with two kinds of data voltage. More specifically, during the first to second frame periods, a data voltage corresponding to a relatively low tone is supplied after a data voltage corresponding to a relatively high tone has been supplied, and during the third to fourth frame periods, a data voltage corresponding to a relatively high tone is supplied after a data voltage corresponding to a relatively low tone has been supplied, whereby the data potentials have their polarities (positive/negative) reversed every frame.

Figure 10:
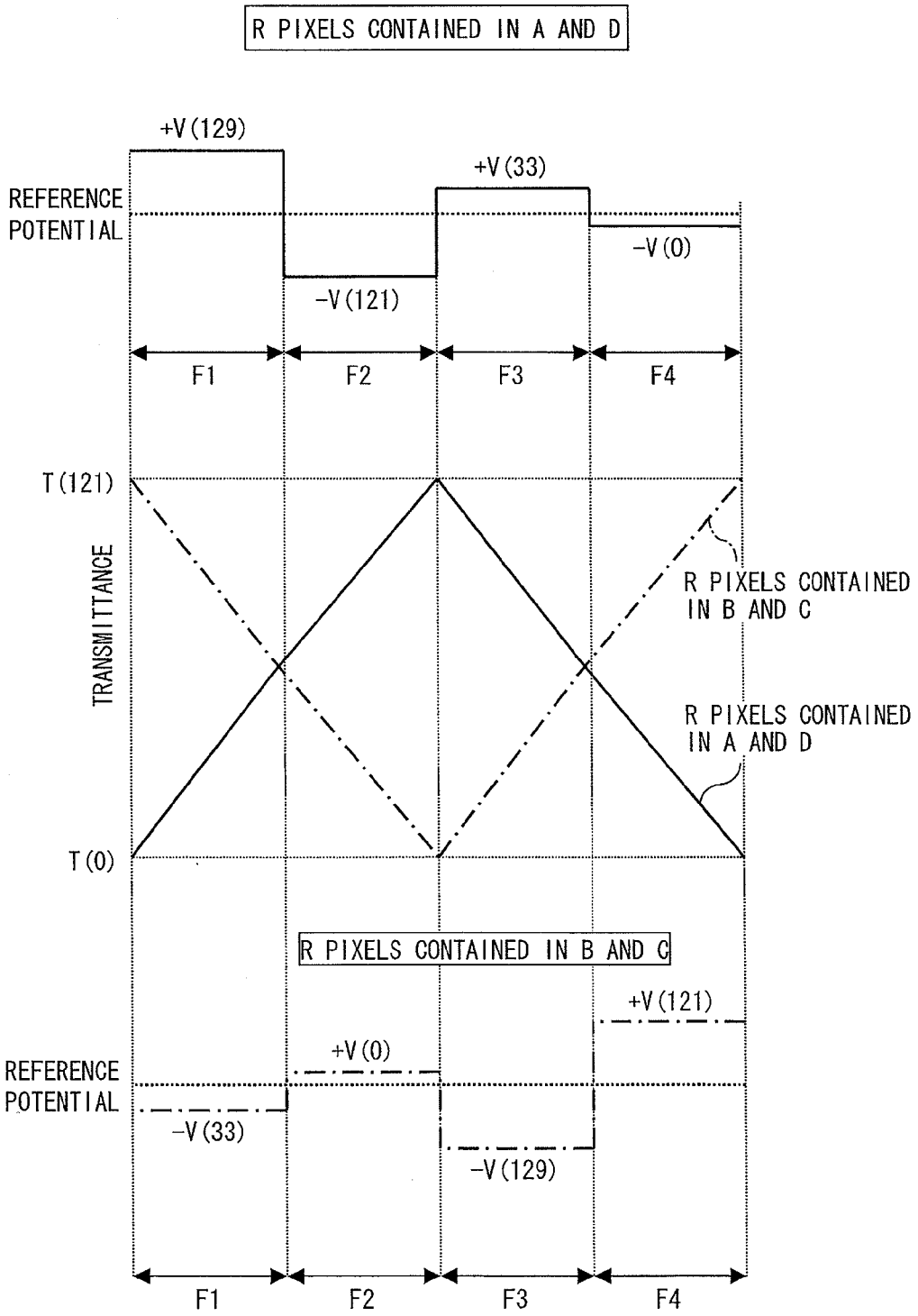
FIG. 10 is a schematic view showing an example of driving (where a tone of 70 is displayed) during the first frame period (F1) to the fourth frame period (F4) and waveforms of response of liquid crystals in the liquid crystal display device.

FIG. 10 is a schematic view showing an example of driving in a case where the liquid crystal display device according to Embodiment 2 carries out a solid display at a tone of 70 continuously for a certain period and waveforms of response (changes in transmittance over time). As shown in FIG. 10, the R pixels contained in the display units A and D (pixels of the first type) are supplied with a positive data potential (+V129) corresponding to a tone of 129 during the first frame period F1, a negative data potential (−V121) corresponding to a tone of 121 during the second frame period F2, a positive data potential (+V33) corresponding to a tone of 33 during the third frame period F3, and a negative data potential (−V0) corresponding to a tone of 0 during the fourth frame period F4. That is, during F1 to F2, two effective voltages of different magnitudes are applied to the R pixels contained in the display units A and D (pixels of the first type) by supplying the R pixels with two kinds of data voltage, and during F3 to F4, too, two effective voltages of different magnitudes are applied to the R pixels by supplying the R pixels with two kinds of data voltage. More specifically, during the first to second frame periods, a data voltage corresponding to a relatively low tone is supplied after a data voltage corresponding to a relatively high tone has been supplied, and during the third to fourth frame periods, a data voltage corresponding to a relatively high tone is supplied after a data voltage corresponding to a relatively low tone has been supplied, whereby the data potentials have their polarities (positive/negative) reversed every frame. Meanwhile, the R pixels contained in the display units B and C (pixels of the second type) are supplied with a negative data potential (−V33) corresponding to a tone of 33 during the first frame period F1, a positive data potential (+V0) corresponding to a tone of 0 during the second frame period F2, a negative data potential (−V129) corresponding to a tone of 129 during the third frame period F3, and a positive data potential (+V121) corresponding to a tone of 121 during the fourth frame period F4. That is, during F1 to F2, two effective voltages of different magnitudes are applied to the R pixels contained in the display units B and C (pixels of the second type) by supplying the R pixels with two kinds of data voltage, and during F3 to F4, too, two effective voltages of different magnitudes are applied to the R pixels by supplying the R pixels with two kinds of data voltage. More specifically, during the first to second frame periods, a data voltage corresponding to a relatively low tone is supplied after a data voltage corresponding to a relatively high tone has been supplied, and during the third to fourth frame periods, a data voltage corresponding to a relatively high tone is supplied after a data voltage corresponding to a relatively low tone has been supplied, whereby the data potentials have their polarities (positive/negative) reversed every frame.

According to the driving of FIGS. 9 and 10, the waveforms of response of liquid crystal during F1 to F2 and F3 to F4 are linearized, so that the waveform of response of the pixels of the first type during F1 to F4 (single cycle) and the waveform of response of the pixels of the second type during F1 to F4 (single cycle) are substantially triangular and symmetrical with each other about a line. This allows a superimposed wave of a wave of response of the pixels of the first type and a wave of response of the pixels of the second type to take a near-flat waveform, thus making it possible to sufficiently suppress flickers.

Figure 11:
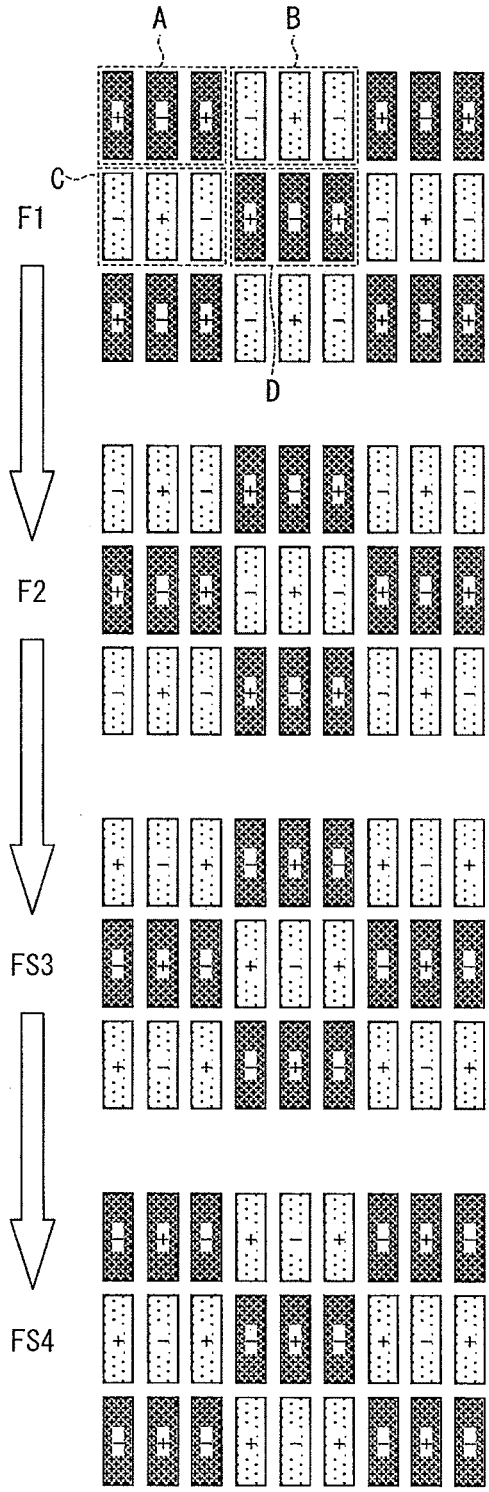
FIG. 11 is a schematic view showing a display state in the examples of driving of FIGS. 9 and 10.

FIG. 11 is a schematic view showing a display state of 27 pixels belonging to nine display units, including the display units A to D, in a case where the driving of FIGS. 9 and 10 is carried out. As shown in FIGS. 9 through 11, in a case where the waveform of response of the pixels of the first type and the waveform of response of the pixels of the second type are rectangular, the average luminance during F1 and the average luminance during F4 are lower than the average luminance during F1 to F4 (luminance corresponding to a tone of 125) in the pixels of the first type (pixels contained in the pixel units A and D), and the average luminance during F2 and the average luminance during F3 are higher than the average luminance during F1 to F4 (luminance corresponding to a tone of 125) in the pixels of the first type. Meanwhile, the average luminance during F1 and the average luminance during F4 are higher than the average luminance during F1 to F4 (luminance corresponding to a tone of 125) in the pixels of the second type (pixels contained in the pixel units B and C), and the average luminance during F2 and the average luminance during F3 are lower than the average luminance during F1 to F4 (luminance corresponding to a tone of 125) in the pixels of the second type.

Embodiment 3

Figure 15:
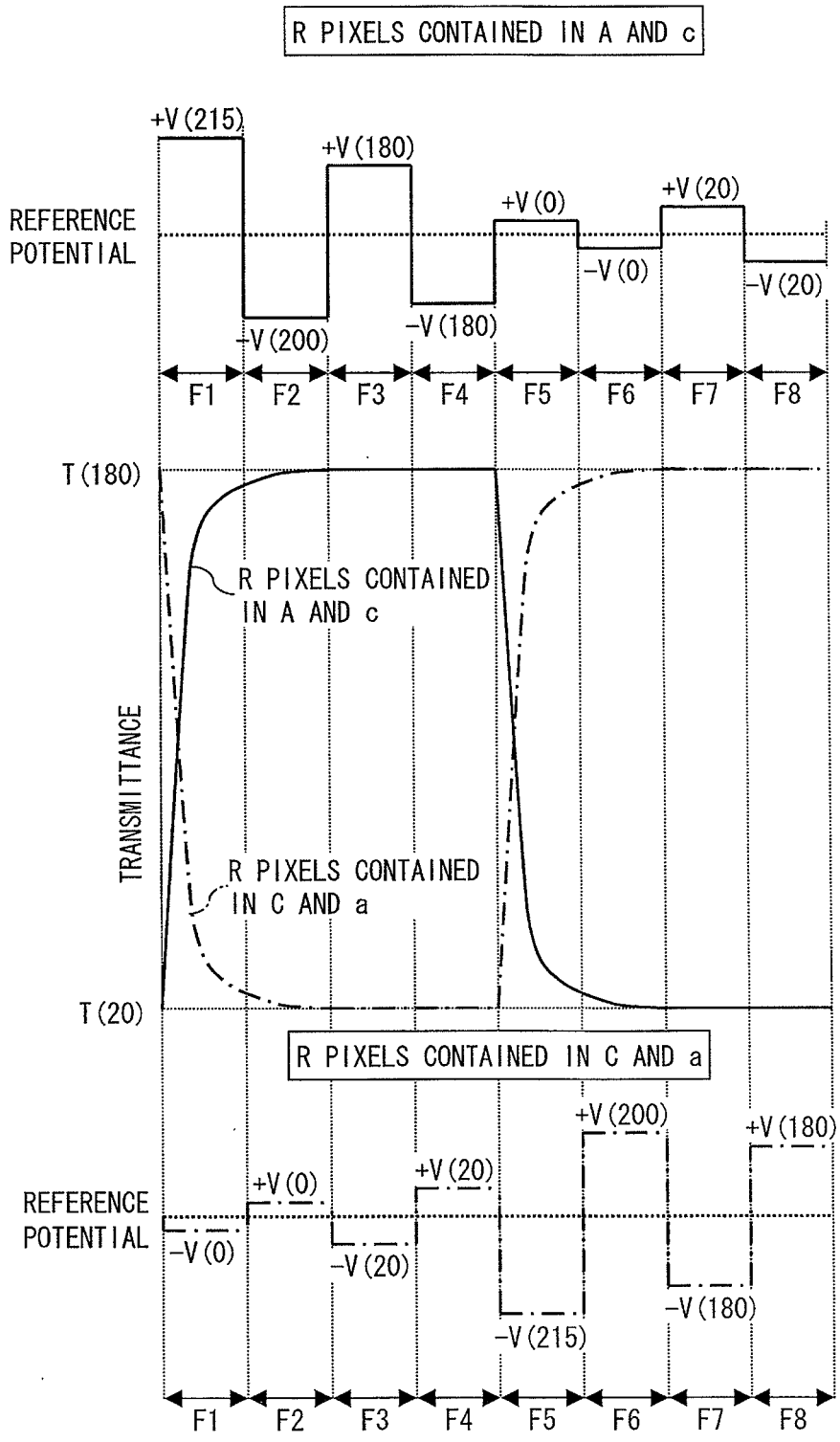
FIG. 15 is a schematic view showing an example of driving (pixels of A, C, a, and c) during the first frame period (F1) to the eighth frame period (F8) and waveforms of response of liquid crystals in the liquid crystal display device.

FIG. 15 is a schematic view showing an example of driving in a case where a liquid crystal display device according to Embodiment 3, in which a single cycle is composed of eight frames, carries out a solid display at a tone of 125 continuously for a certain period and waveforms of response (changes in transmittance over time). As shown in FIG. 15, the R pixels contained in the display units A and c (pixels of the first type) are supplied with a positive data potential (+V215) corresponding to a tone of 215 during the first frame period F1, a negative data potential (−V200) corresponding to a tone of 200 during the second frame period F2, a positive data potential (+V180) corresponding to a tone of 180 during the third frame period F3, a negative data potential (−V0) corresponding to a tone of 0 during the fourth frame period F4, a positive data potential (+V0) corresponding to a tone of 0 during the fifth frame period F5, a negative data potential (−V0) corresponding to a tone of 0 during the sixth frame period F6, a positive data potential (+V20) corresponding to a tone of 20 during the seventh frame period F7, and a negative data potential (−V20) corresponding to a tone of 20 during the eighth frame period F8. That is, during F1 to F4, three effective voltages of different magnitudes are applied to the R pixels contained in the display units A and D (pixels of the first type) by supplying the R pixels with three kinds of data voltage, and during F5 to F8, two effective voltages of different magnitudes are applied to the R pixels by supplying the R pixels with two kinds of data voltage, whereby the data potentials have their polarities (positive/negative) reversed every frame.

Meanwhile, the R pixels contained in the display units C and a (pixels of the second type) are supplied with a negative data potential (−V0) corresponding to a tone of 0 during the first frame period F1, a positive data potential (+V0) corresponding to a tone of 0 during the second frame period F2, a negative data potential (−V20) corresponding to a tone of 20 during the third frame period F3, a positive data potential (+V20) corresponding to a tone of 20 during the fourth frame period F4, a negative data potential (−V215) corresponding to a tone of 215 during the fifth frame period F5, a positive data potential (+V200) corresponding to a tone of 200 during the sixth frame period F6, a negative data potential (−V180) corresponding to a tone of 180 during the seventh frame period F7, and a positive data potential (+V180) corresponding to a tone of 180 during the eighth frame period F8. That is, during F1 to F4, two effective voltages of different magnitudes are applied to the R pixels contained in the display units C and a (pixels of the second type) by supplying the R pixels with two kinds of data voltage, and during F5 to F8, three effective voltages of different magnitudes are applied to the R pixels by supplying the R pixels with three kinds of data voltage, whereby the data potentials have their polarities (positive/negative) reversed every frame.

According to the driving of FIG. 15, the R pixels contained in the display units A and c (pixels of the first type) are overdriven during F1, F2, F5, and F6, and the R pixels contained in the display units C and a (pixels of the second type) are also overdriven during F1, F2, F5, and F6, so that as shown in FIG. 15, the waveform of response of the pixels of the first type during F1 to F8 (single cycle) and the waveform of response of the pixels of the second type during F1 to F8 (single cycle) are substantially rectangular and symmetrical with each other about a line. This allows a superimposed wave of a wave of response of the pixels of the first type and a wave of response of the pixels of the second type to take a near-flat waveform, thus making it possible to sufficiently suppress flickers. Furthermore, overdriving the pixels of the first type and the pixels of the second type causes a greater change in luminance per cycle, thus achieving a further improvement in viewing angle characteristic.

Figure 16:
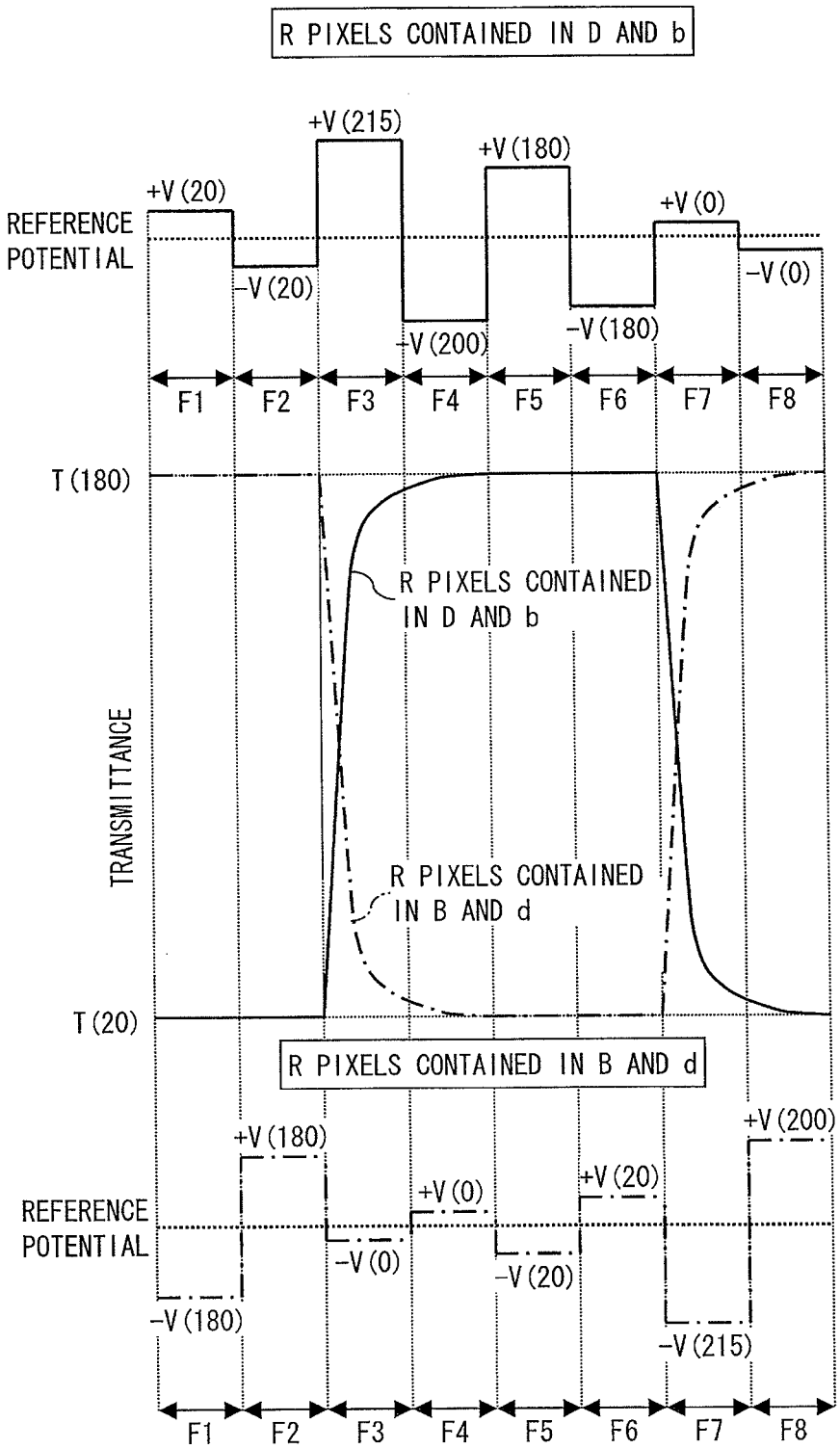
FIG. 16 is a schematic view showing an example of driving (pixels of B, D, b, and d) during the first frame period (F1) to the eighth frame period (F8) and waveforms of response of liquid crystals in the liquid crystal display device.
Figure 17:
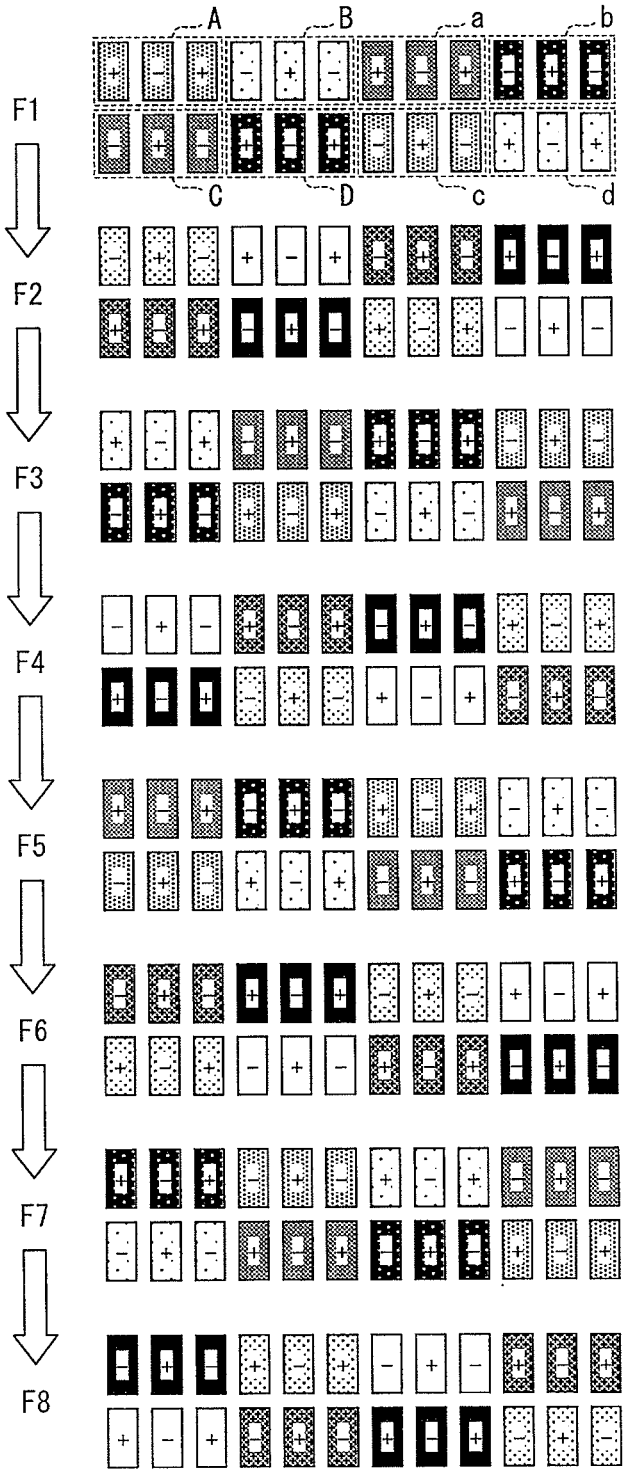
FIG. 17 is a schematic view showing a display state in the examples of driving of FIGS. 15 and 16.

In Embodiment 3, it is preferable that the R pixels contained in the display units D and b and the R pixels contained in the display units B and d be driven as shown in FIG. 16. This brings about four kinds of pattern of change in luminance during a single cycle, thus achieving further suppression of flickers.

[As to Each of the Embodiments]

In each of the embodiments described above, the polarity of a data potential that is written to one of two pixels adjacent to each other in the row-wise direction and the polarity of a data potential that is written to the other pixel are different from each other, and the polarity of a data potential that is written to one of two pixels adjacent to each other in the column-wise direction and the polarity of a data potential that is written to the other pixel are different from each other, whereby the polarities of data potentials that are written to the pixels are in the form of dot reversal. This achieves suppression of flickers that are caused by voltages pulled in when the transistors were OFF.

Figure 18:
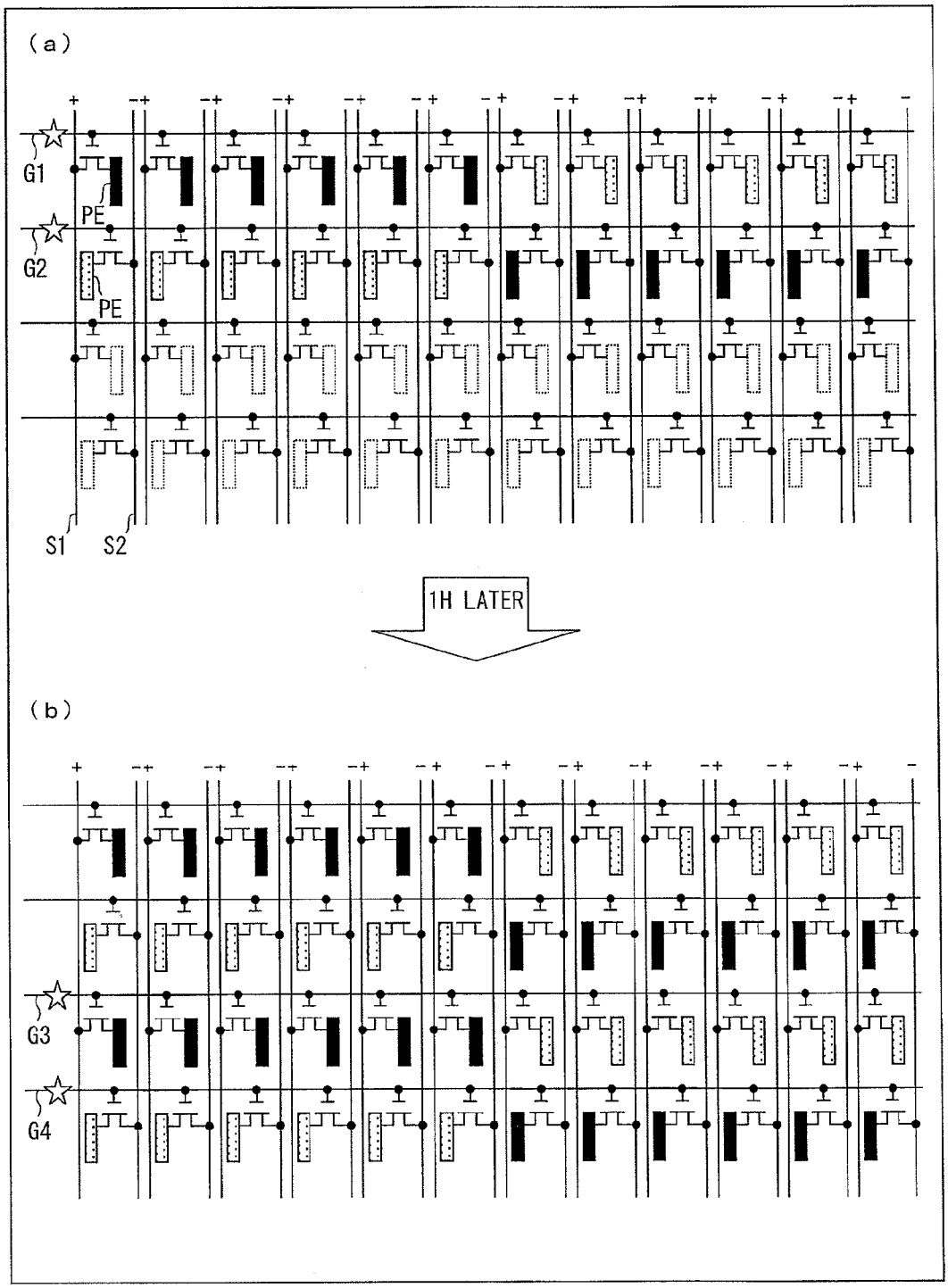
FIG. 18 is a schematic view showing a configuration of a liquid crystal panel for use in the liquid crystal display device and a method for driving the liquid crystal panel.
Figure 19:
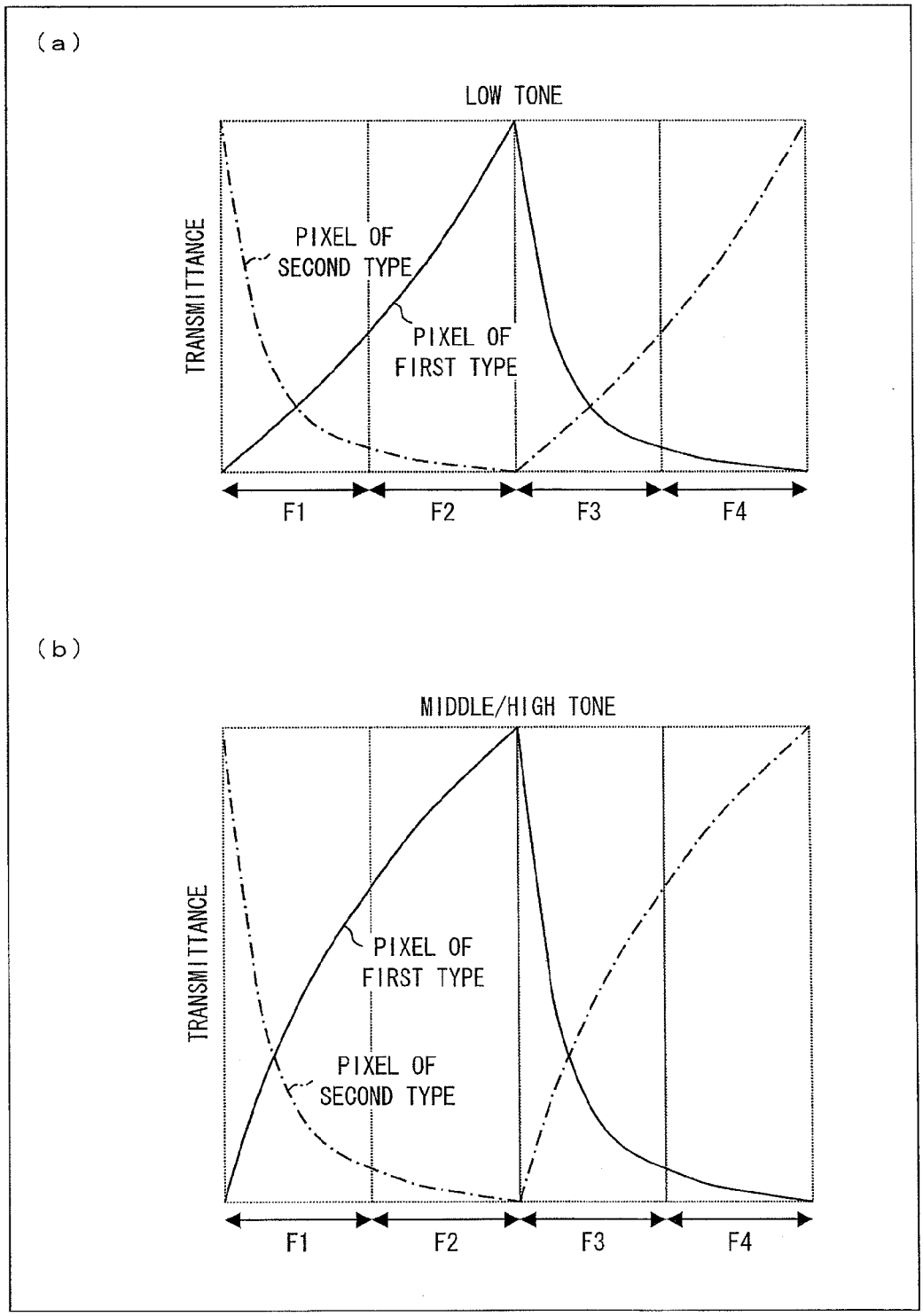
FIG. 19 is a schematic view showing an example of driving during the first frame period (F1) to the fourth frame period (F4) and waveforms of response of liquid crystals in a conventional liquid crystal display device.

FIG. 18 is a schematic view showing a configuration of a liquid crystal panel in the liquid crystal device and an example of driving of the liquid crystal panel. In the liquid crystal panel, a single column of pixel is provided with two data signal lines S1 and S2 corresponding thereto, and a pixel electrode contained in one of two pixels adjacent to each other within the same column of pixels and a pixel electrode contained in the other pixel are connected to different data signal lines via transistors. Moreover, two scanning signal lines are selected at a time, and the two data signal lines S1 and S2 corresponding to the single column of pixels are supplied with data potentials of opposite polarities. For example, in (a) of FIG. 18, the scanning signal lines G1 and G2 are selected, and a positive data potential (analog potential) is written to each pixel electrode PE connected to the scanning signal line G1 and the data signal line S1 via a transistor and a negative data potential (analog potential) is written to each pixel electrode PE connected to the scanning signal line G2 and the data signal line S2 via a transistor. Further, in (b) of FIG. 18 1 H after (a) of FIG. 18, the scanning signal lines G3 and G4 are selected, and a positive data potential (analog potential) is written to each pixel electrode PE connected to the scanning signal line G3 and the data signal line S1 via a transistor and a negative data potential (analog potential) is written to each pixel electrode PE connected to the scanning signal line G4 and the data signal line S2 via a transistor.

Although, in each of the embodiments described above, the polarities of data potentials that are written to the pixels are in the form of dot reversal, this does not imply any limitation. For example, the polarities of data potentials that are written to the pixels are in the form of V-line reversal such that while the polarity of a data potential that is written to one of two pixels adjacent to each other in the row-wise direction and the polarity of a data potential that is written to the other pixel are different from each other, the polarity of a data potential that is written to one of two pixels adjacent to each other in the column-wise direction and the polarity of a data potential that is written to the other pixel are identical to each other.

The liquid crystal display device can be said to be configured as follows: When the liquid crystal display device carries out such a display that with a single cycle composed of first to mth frame periods (m is an integer of 4 or more), the average luminance during a single cycle in each of two pixels takes on an identical value corresponding to a halftone, periods of time are provided in which the luminance of one of the two pixels rises to reach a targeted value and the luminance of the other pixel drops to reach a targeted value, and during these periods of time, one or more kinds of waveform adjusting voltage and a voltage corresponding to the targeted value are applied to either or each of the two pixels.

For example, in FIG. 4, with a single cycle composed of first to fourth frames F1 to F4, periods of time (F1 and F2) are provided in which the luminance of one (solid line) of the two pixels rises to reach a targeted value (value corresponding to T(184)) and the luminance of the other pixel (broken line) drops to reach a targeted value (value corresponding to T(0)), and during these periods of time, a waveform adjusting voltage (+V(219)) and a voltage (−V(184)) corresponding to the targeted value are applied to the one (solid line) of the two pixels. Further, periods of time (F3 and F4) are provided in which the luminance of one (broken line) of the two pixels rises to reach a targeted value (value corresponding to T(184)) and the luminance of the other pixel (solid line) drops to reach a targeted value (value corresponding to T(0)), and during these periods of time, a waveform adjusting voltage (−V(219)) and a voltage (+V(184)) corresponding to the targeted value are applied to the one (broken line) of the two pixels.

For example, in FIG. 9, with a single cycle composed of first to fourth frames F1 to F4, periods of time (F1 and F2) are provided in which the luminance of one (solid line) of the two pixels rises to reach a targeted value (value corresponding to T(202)) and the luminance of the other pixel (broken line) drops to reach a targeted value (value corresponding to T(0)), and during these periods of time, a waveform adjusting voltage (+V(180)) and a voltage (−V(202)) corresponding to the targeted value are applied to the one (solid line) of the two pixels. Further, periods of time (F3 and F4) are provided in which the luminance of one (broken line) of the two pixels rises to reach a targeted value (value corresponding to T(202)) and the luminance of the other pixel (solid line) drops to reach a targeted value (value corresponding to T(0)), and during these periods of time, a waveform adjusting voltage (−V(180)) and a voltage (+V(202)) corresponding to the targeted value are applied to the one (broken line) of the two pixels.

For example, in FIG. 16, with a single cycle composed of first to eighth frames F1 to F8, periods of time (F3 to F6) are provided in which the luminance of one (solid line) of the two pixels rises to reach a targeted value (value corresponding to T(180)) and the luminance of the other pixel (broken line) drops to reach a targeted value (value corresponding to T(20)), and during these periods of time, waveform adjusting voltages (+V(215) and −V(200)) and voltages (±V(180)) corresponding to the targeted values are applied to the one (solid line) of the two pixels and waveform adjusting voltages (±V(0) and voltages (±V(20)) corresponding to the targeted value) are applied to the other pixel (broken line).

The present invention is not limited to the description of the embodiments above, but may be altered by a skilled person within the scope of the claims. An embodiment based on a proper combination of technical means disclosed in different embodiments is encompassed in the technical scope of the present invention.

A liquid crystal display device of the present invention is suitable, for example, for liquid crystal televisions.

The invention claimed is:

1. A liquid crystal display device which carries out a single tone display with a change in pixel luminance during a single cycle composed of first to mth frame periods (m is an integer of 4 or more), comprising pixels and a source driver for supplying data voltages to each of the pixels, the pixels comprising:

a pixel of a first type in which when a halftone is displayed successively, supply of two or more kinds of data voltage to apply a plurality of effective voltages of different magnitudes to the pixel of the first type during at least either the first to nth frame periods (n is an integer of 2 or more to m or less) or the (n+1)th to mth frame periods causes liquid crystal layers to produce rise responses during the first to nth frame periods and produce decay responses during the (n+1)th to mth frame periods; and a pixel of a second type in which when the halftone is displayed successively, supply of two or more kinds of data voltage to apply a plurality of effective voltages of different magnitudes to the pixel of the second type during at least either the first to nth frame periods or the (n+1)th to mth frame periods causes liquid crystal layers to produce decay responses during the first to nth frame periods and produce rise responses during the (n+1)th to mth frame periods.

2. The liquid crystal display device as set forth in claim 1, wherein data voltages that are supplied to the pixels of the first and second types when a halftone is displayed are set so that a wave of response during a single cycle in the pixel of the first type and a wave of response during a single cycle in the pixel of the second type are substantially symmetrical with each other about a line.

3. The liquid crystal display device as set forth in claim 2, wherein the data voltages that are supplied to the pixels of the first and second types when a halftone is displayed are set so that a wave of response during a single cycle in the pixels of each of the first and second types is substantially a rectangular wave or a trapezoidal wave.

4. The liquid crystal display device as set forth in claim 3, wherein while a halftone is displayed in the pixel of the first type by, during the first to nth frame periods, supplying a data voltage corresponding to a relatively low tone after having supplied a data voltage corresponding to a relatively high tone, a halftone is displayed in the pixel of the second type by, during the (n+1)th to mth frame periods, supplying a data voltage corresponding to a relatively low tone after having supplied a data voltage corresponding to a relatively high tone.

5. The liquid crystal display device as set forth in claim 3, wherein each of the pixels of the first and second types is supplied with a precedent effective voltage corresponding to a value beyond a first target value and an effective voltage corresponding to the first target value, in the rise responses and each of the pixels of the first and second types is supplied with a precedent effective voltage corresponding to a value which does not reach a second target value and an effective voltage corresponding to the second target value, in the decay responses.

6. The liquid crystal display device as set forth in claim 2, wherein the data voltages that are supplied to the pixels of the first and second types when a halftone is displayed are set so that a wave of response during a single cycle in the pixels of each of the first and second types is substantially a triangular wave or a sinusoidal wave.

7. The liquid crystal display device as set forth in claim 6, wherein while a halftone at a predetermined tone or higher is displayed in the pixels of the first type by, during the first to nth frame periods, supplying a data voltage corresponding to a relatively high tone after having supplied a data voltage corresponding to a relatively low tone and by, during the (n+1)th to mth frame periods, supplying a data voltage corresponding to a relatively low tone after having supplied a data voltage corresponding to a relatively high tone, a halftone at a predetermined tone or higher is displayed in the pixels of the second type by, during the first to nth frame periods, supplying a data voltage corresponding to a relatively low tone after having supplied a data voltage corresponding to a relatively high tone and by, during the (n+1)th to mth frame periods, supplying a data voltage corresponding to a relatively high tone after having supplied a data voltage corresponding to a relatively low tone.

8. The liquid crystal display device as set forth in claim 6, wherein while a halftone at less than a predetermined tone is displayed in the pixels of the first type by, during the first to nth frame periods, supplying a data voltage corresponding to a relatively low tone after having supplied a data voltage corresponding to a relatively high tone and by, during the (n+1)th to mth frame periods, supplying a data voltage corresponding to a relatively low tone after having supplied a data voltage corresponding to a relatively high tone, a halftone at less than a predetermined tone is displayed in the pixels of the second type by, during the first to nth frame periods, supplying a data voltage corresponding to a relatively low tone after having supplied a data voltage corresponding to a relatively high tone and by, during the (n+1)th to mth frame periods, supplying a data voltage corresponding to a relatively low tone after having supplied a data voltage corresponding to a relatively high tone.

9. The liquid crystal display device as set forth in claim 6, wherein each of the pixels of the first and second types is supplied with a precedent effective voltage corresponding to a value which does not reach a third target value and an effective voltage corresponding to the third target value, in the rise responses and each of the pixels of the first and second types is supplied with a precedent effective voltage corresponding to a value which does not reach a fourth target value and an effective voltage corresponding to the fourth target value, in the decay responses.

10. The liquid crystal display device as set forth in claim 1, wherein m=4 and n=2, or m=8 and n=4.

11. The liquid crystal display device as set forth in claim 1, wherein:

display units each composed of a plurality of pixels of different colors are arranged in row- and column-wise directions; and the plurality of pixels contained in the same display unit are of the same type.

12. The liquid crystal display device as set forth in claim 11, wherein the type of pixels contained in one of two display units adjacent to each other in a scanning direction and the type of pixels contained in the other display unit are different from each other.

13. The liquid crystal display device as set forth in claim 11, wherein the type of pixels contained in one of two display units adjacent to each other in a direction orthogonal to a scanning direction and the type of pixels contained in the other display unit are different from each other.

14. The liquid crystal display device as set forth in claim 11, wherein the display units are each composed of a red pixel, a green pixel, and a blue pixel.

15. The liquid crystal display device as set forth in claim 11, wherein the number of display units composed of pixels of the first type and the number of display units composed of pixels of the second type are substantially equal to each other.

16. The liquid crystal display device as set forth in claim 1, wherein a frame frequency is 75 Hz or higher.

17. The liquid crystal display device as set forth in claim 1, wherein each of the pixels is supplied with data potentials whose polarities are reversed every frame.

18. The liquid crystal display device as set forth in claim 1, wherein the polarity of a data potential that is written to one of two pixels adjacent to each other in a scanning direction and the polarity of a data potential that is written to the other pixel are different from each other.

19. The liquid crystal display device as set forth in claim 1, wherein the polarity of a data potential that is written to one of two pixels adjacent to each other in a direction orthogonal to a scanning direction and the polarity of a data potential that is written to the other pixel are different from each other.

20. The liquid crystal display device as set forth in claim 1, wherein assuming a scanning direction is a column-wise direction, each column of pixels is provided with two data signal lines corresponding thereto, and two pixels adjacent to each other in the column-wise direction are connected to different data signal lines via transistors, so that two scanning signal lines are selected at a time.

21. The liquid crystal display device as set forth in claim 20, wherein the two data signal lines provided in correspondence with each column of pixels are provided with data potentials of opposite polarities.

22. A television receiver comprising:

a liquid crystal display device as set forth in claim 1; and a tuner section for receiving a television broadcast.

23. A liquid crystal display device comprising pixels and a source driver for supplying data voltages to each of the pixels, wherein when such a display is carried out successively that with a single cycle composed of first to mth frame periods (m is an integer of 4 or more), an average luminance during a single cycle in each of two pixels takes on an identical value corresponding to a halftone, a term is provided in which the luminance of one of the two pixels rises to reach a targeted value and the luminance of the other pixel drops to reach a targeted value, and during the term, a plurality of effective voltages of different magnitudes corresponding to a waveform adjusting data voltage and a data voltage for the targeted value are applied to either or each of the two pixels.

* * * * *